US007387324B1

(12) United States Patent
Sharpe

(10) Patent No.: US 7,387,324 B1
(45) Date of Patent: Jun. 17, 2008

(54) ERGONOMIC HANDLE TO CARRY PLASTIC SHOPPING BAGS

(76) Inventor: Margaret Ruth Sharpe, 378 Avocado St., Apt. # 6, Costa Mesa, CA (US) 92627

( * ) Notice: Subject to any disclaimer, the term of this patent is extended or adjusted under 35 U.S.C. 154(b) by 0 days.

(21) Appl. No.: 10/328,444

(22) Filed: Dec. 23, 2002

Related U.S. Application Data

(60) Provisional application No. 60/342,303, filed on Dec. 21, 2001.

(51) Int. Cl.
*A45F 5/10* (2006.01)
*B65D 33/06* (2006.01)

(52) U.S. Cl. ..... 294/171; 294/137; 16/425; 16/430

(58) Field of Classification Search ..... 294/137, 294/171, 170; 16/406, 425, 430; 383/13, 383/25, 26; D9/434, 455
See application file for complete search history.

(56) References Cited

U.S. PATENT DOCUMENTS

| | | | | |
|---|---|---|---|---|
| 452,830 | A * | 5/1891 | Bowie et al. | 224/220 |
| D29,380 | S | 9/1898 | Schanck | D8/395 |
| 645,670 | A | 3/1900 | Ottignon | |
| 743,945 | A | 11/1903 | Soden | |
| 1,000,118 | A | 8/1911 | Pope | |
| 1,226,403 | A | 5/1917 | Snyder | |
| 1,268,775 | A | 6/1918 | Stanger | |
| 1,564,101 | A | 12/1925 | Nakamura | |
| 1,576,546 | A | 3/1926 | Ranson | |
| 1,618,854 | A | 2/1927 | Worth | |
| 1,781,583 | A | 11/1930 | Hodgson | |
| 2,272,854 | A | 2/1942 | Sloane et al. | 150/34 |

(Continued)

FOREIGN PATENT DOCUMENTS

| | | | | |
|---|---|---|---|---|
| EP | 378958 | * | 7/1990 | 294/171 |

(Continued)

OTHER PUBLICATIONS

Discovered on Jun. 18, 2001 "Hand-EZ" TM ("A Handle Wrapper") http://www.galaxymall.com/household/baghandles/index.html.

(Continued)

*Primary Examiner*—Dean J Kramer

(57) ABSTRACT

An ergonomic handle (22) used to carry loaded plastic grocery bags and baskets more comfortably, and providing a way to hold all of the bag handles together. The handle (22) comprises: a rigid inner tubular structure (30), a soft outer foam casing (60), a connector (80), a clip (90), and elastic band (140), and possibly a key ring (150). Tube (30) provides support for the hand, access of bag handles to a confined storage space in handle (22), a guiding mechanism, a locking mechanism, and an aperture to attach handle (22) to other objects. The ergonomically shaped foam casing (60) that surrounds tube (30) provides cushioning and helps the handle conform to different sized hands. Connector (80) provides an easy way to attach handle (22) to clip (90). Clip (90) provides a quick and easy way to attach handle (22) to key ring (150)—to keep the handle accessible and visible. Elastic band (140) provides a way to close the wide mouth of plastic bags (to keep the contents inside). Band (140) may also be attached to clip (90) to provide a new way to transport and store handle (22) in visible locations. Band (140) may also be attached to a key ring (150) for transportation and storage of keys.

40 Claims, 11 Drawing Sheets

U.S. PATENT DOCUMENTS

Figure 8A:
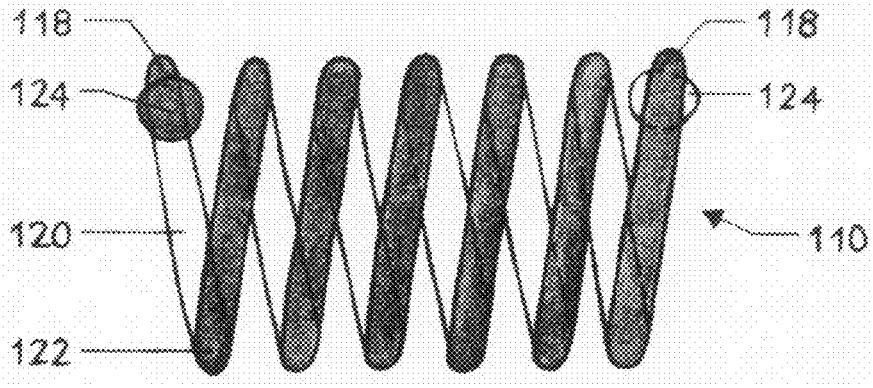

| | | | | | |
|---|---|---|---|---|---|
| 2,287,329 | A | | 6/1942 | Santa Maria et al. | 229/54 |
| 2,444,558 | A | | 7/1948 | Elliott | 224/57 |
| 2,448,894 | A | | 9/1948 | Laus | 16/114 |
| D152,157 | S | | 12/1948 | Jones | D17/5 |
| 2,506,781 | A | | 5/1950 | Elliott | 224/57 |
| D159,141 | S | | 6/1950 | Conrad | D17/5 |
| 2,717,411 | A | | 9/1955 | Taipale | 16/114 |
| 2,800,940 | A | | 7/1957 | Riesebeck | 150/12 |
| 3,083,366 | A | | 3/1963 | Franges | 16/114 |
| 3,149,367 | A | | 9/1964 | Dills | 16/110 |
| 3,268,134 | A | | 8/1966 | Baston et al. | 224/55 |
| 3,382,615 | A | | 5/1968 | Adell | 49/462 |
| 3,800,361 | A | | 4/1974 | Stauffer | 16/116 |
| 3,912,140 | A | | 10/1975 | Franges | 224/45 P |
| 3,913,172 | A | | 10/1975 | Richards et al. | 16/114 B |
| 4,071,063 | A | | 1/1978 | Russell | 150/12 |
| D258,279 | S | | 2/1981 | Moore | D12/70 |
| 4,262,385 | A | | 4/1981 | Norman | 16/114 R |
| 4,298,999 | A | | 11/1981 | Mackey | 7/170 |
| D269,253 | S | | 6/1983 | Gagnon | D9/434 |
| D275,945 | S | | 10/1984 | Adell | D12/190 |
| 4,590,640 | A | | 5/1986 | Enersen | 16/114 B |
| D289,152 | S | | 4/1987 | Fritz | D12/190 |
| 4,705,249 | A | | 11/1987 | Edwards | 248/101 |
| 4,723,740 | A | | 2/1988 | Courtemanche et al. | 248/95 |
| D305,297 | S | | 1/1990 | O'Neill | D8/300 |
| 4,890,355 | A | | 1/1990 | Schulten | 16/111 R |
| 4,932,702 | A | | 6/1990 | Sweeny | 294/171 |
| D314,150 | S | | 1/1991 | Preciutti | D9/455 |
| 4,982,989 | A | | 1/1991 | Sweeny | 294/171 |
| 5,005,891 | A | | 4/1991 | Lunsford | 294/171 |
| 5,029,926 | A | | 7/1991 | Dieterich, Jr. | 294/171 |
| 5,060,998 | A | * | 10/1991 | Phillips | 294/146 |
| D325,156 | S | | 4/1992 | Sweeny | D8/300 |
| D329,973 | S | * | 10/1992 | Schuttinga | D9/434 |
| 5,199,758 | A | * | 4/1993 | Howell | 294/171 |
| D335,448 | S | | 5/1993 | Laferla | D9/434 |
| 5,217,438 | A | | 6/1993 | Davis et al. | 604/198 |
| 5,364,148 | A | | 11/1994 | Bartocci | 294/171 |
| D362,181 | S | * | 9/1995 | Meyers et al. | D9/434 |
| 5,487,582 | A | | 1/1996 | Bourgeois et al. | 294/146 |
| D367,817 | S | | 3/1996 | Halpin et al. | D9/434 |
| 5,511,445 | A | | 4/1996 | Hildebrandt | 74/558.5 |
| D372,425 | S | | 8/1996 | Kirkwood | D9/434 |
| D374,621 | S | | 10/1996 | Salazar, Jr. | D9/434 |
| 5,599,052 | A | * | 2/1997 | Van Davelaar | 294/159 |
| 5,658,029 | A | | 8/1997 | Franko | 294/171 |
| D384,279 | S | | 9/1997 | Hepworth | D9/434 |
| 5,681,243 | A | | 10/1997 | Criss | 482/49 |
| 5,738,401 | A | | 4/1998 | Fan | 294/171 |
| D394,956 | S | * | 6/1998 | Fruecht | D3/318 |
| 5,803,522 | A | | 9/1998 | Lisbon | 294/171 |
| D403,035 | S | | 12/1998 | MacPherson | D8/303 |
| D409,913 | S | | 5/1999 | Le Roux | D9/434 |
| D411,093 | S | | 6/1999 | Selig et al. | D8/321 |
| 5,992,803 | A | | 11/1999 | LeRoux | 248/100 |
| 6,017,072 | A | * | 1/2000 | Grant | 294/146 |
| D423,348 | S | | 4/2000 | Le Roux | D9/434 |
| D429,454 | S | * | 8/2000 | Lademann, III | D8/303 |
| D436,036 | S | | 1/2001 | Manseau et al. | D9/434 |
| D441,653 | S | | 5/2001 | LeRoux | D9/434 |
| D446,652 | S | * | 8/2001 | Quintana | D3/328 |
| D448,992 | S | | 10/2001 | Bargsten et al. | D9/434 |
| 6,334,239 | B1 | * | 1/2002 | Kraut | 24/3.6 |
| D456,264 | S | | 4/2002 | Lalande | D9/455 |
| 6,378,925 | B1 | | 4/2002 | Greenlee | 294/171 |
| 6,395,319 | B1 | | 5/2002 | Öien | 426/132 |

FOREIGN PATENT DOCUMENTS

| | | | | |
|---|---|---|---|---|
| GB | 2 228 860 | * | 9/1990 | 294/171 |
| GB | 2246285 | * | 1/1992 | 294/171 |

OTHER PUBLICATIONS

"Handy Wormy", no date.
"Good Grips Bag Handles", no date.
"Practikal Carrier Bag Handles", no date.
"Carrieez Carrier Bag Handle", no date.

* cited by examiner

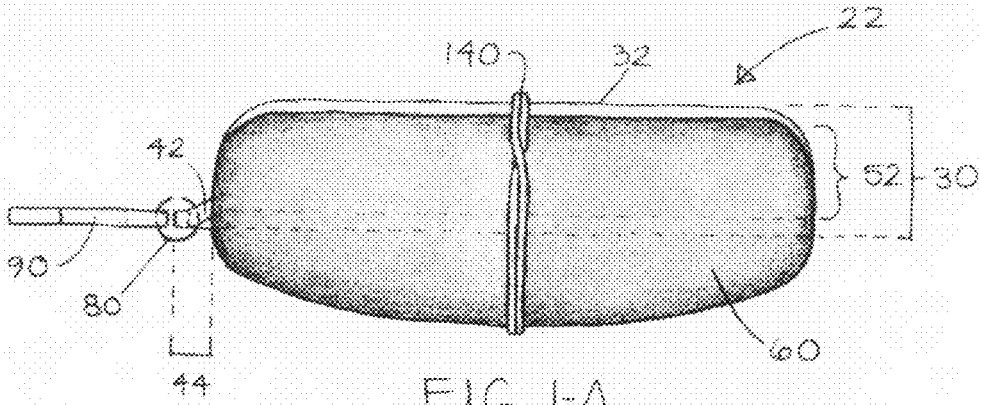
FIG. 1-A
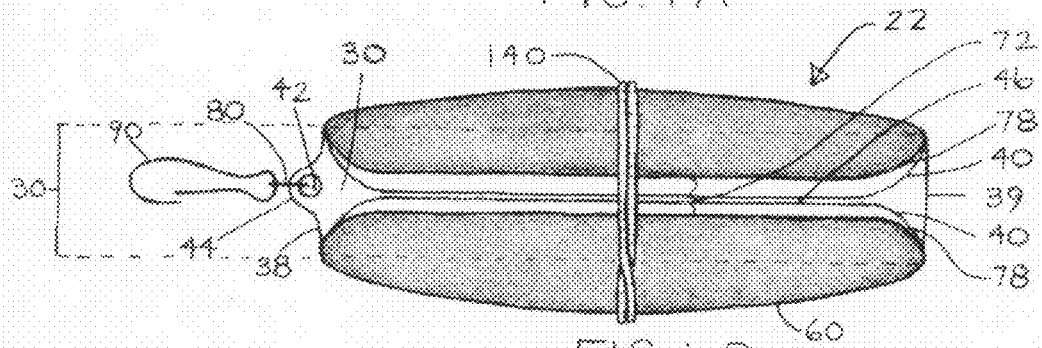
FIG. 1-B
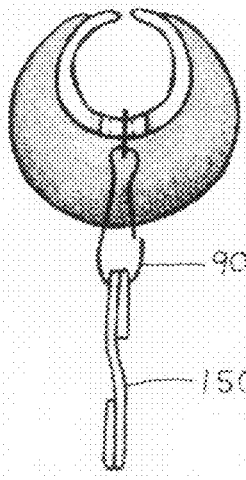
FIG. 1-D
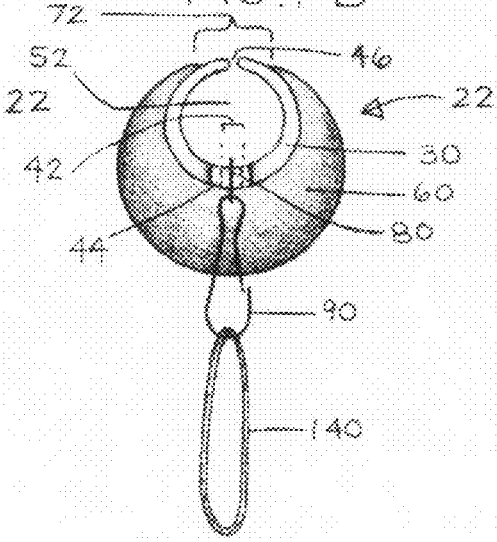
FIG. 1-C

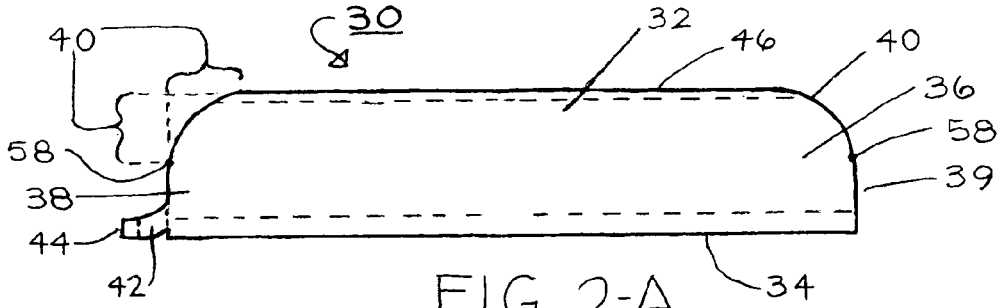
FIG. 2-A
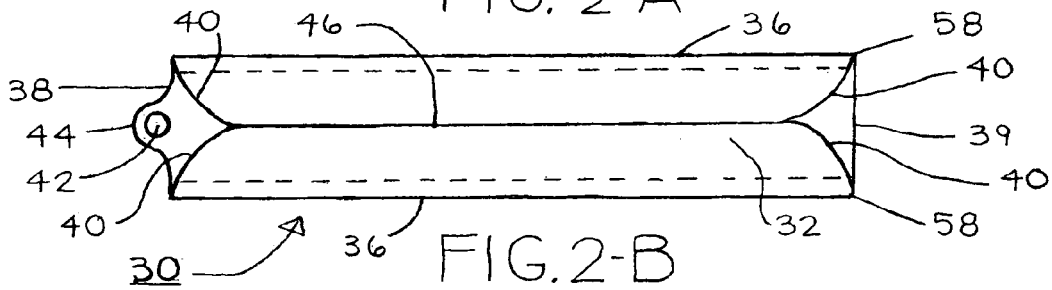
FIG. 2-B
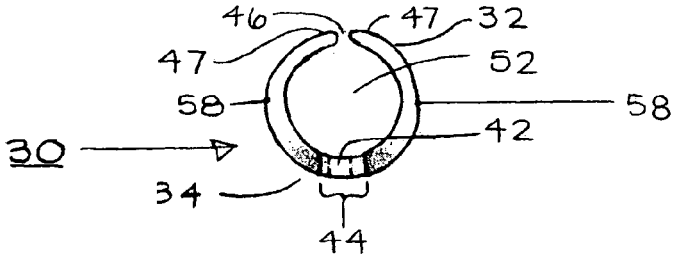
FIG. 2-C
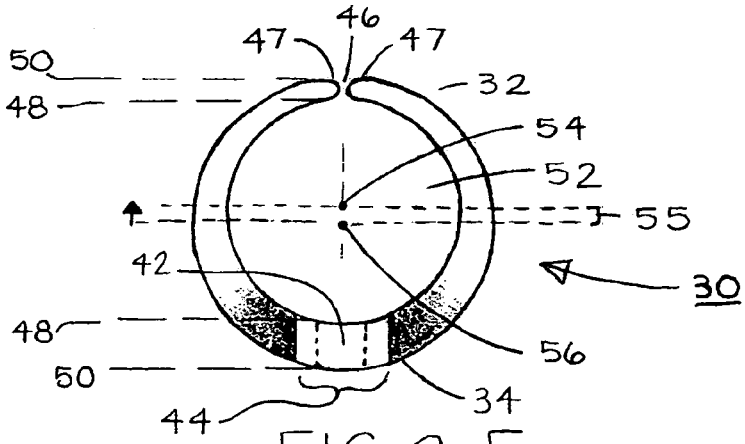
FIG. 2-E

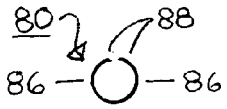
FIG. 3-A
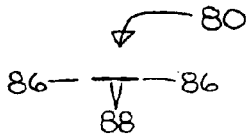
FIG. 3-B
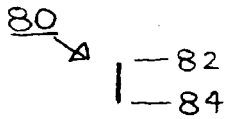
FIG. 3-C
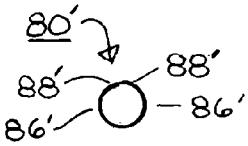
FIG. 3'-A
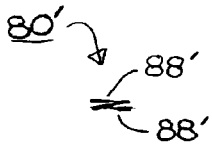
FIG. 3'-B
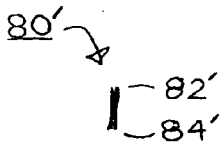
FIG. 3'-C
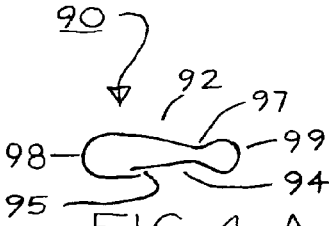
FIG. 4-A
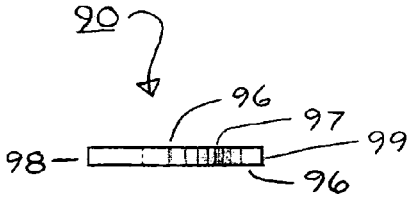
FIG. 4-B
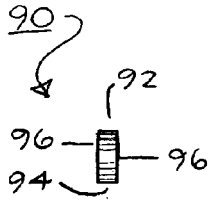
FIG. 4-C
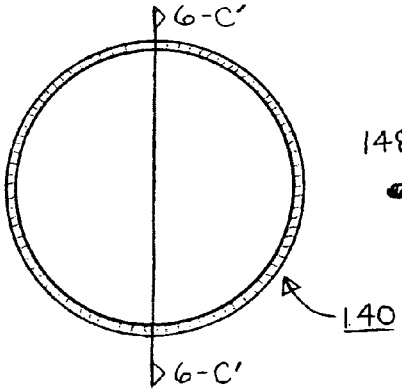
FIG. 6-A
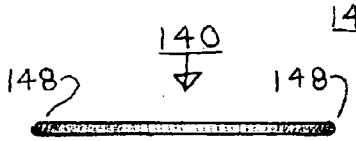
FIG. 6-B
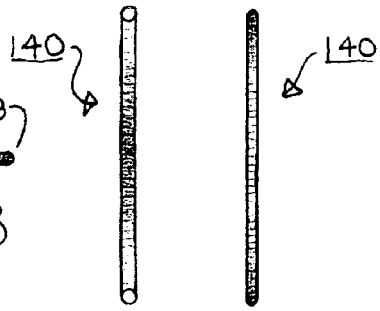
FIG. 6-C'
FIG. 6-C

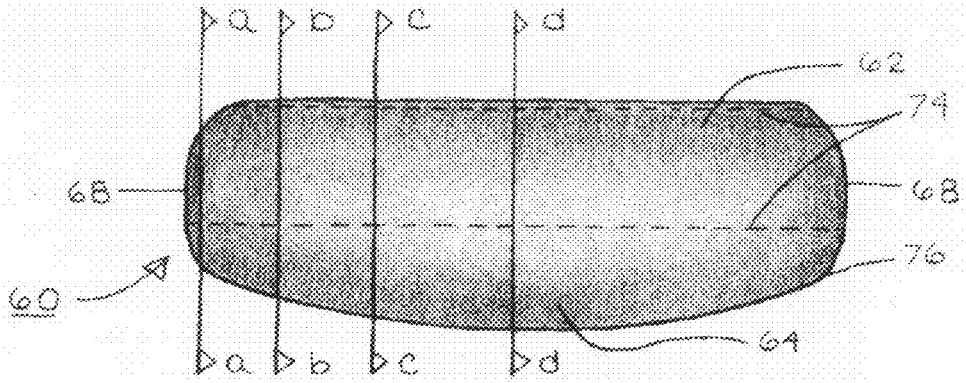
FIG. 5-A
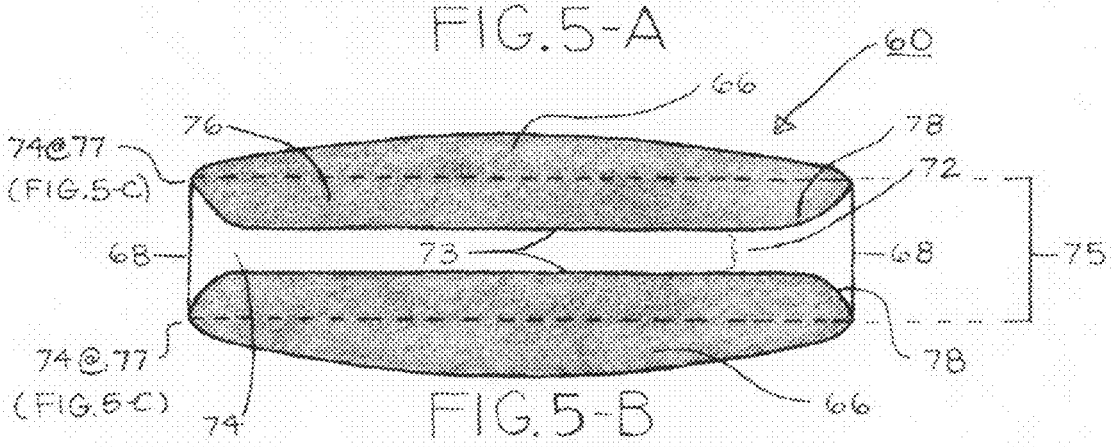
FIG. 5-B
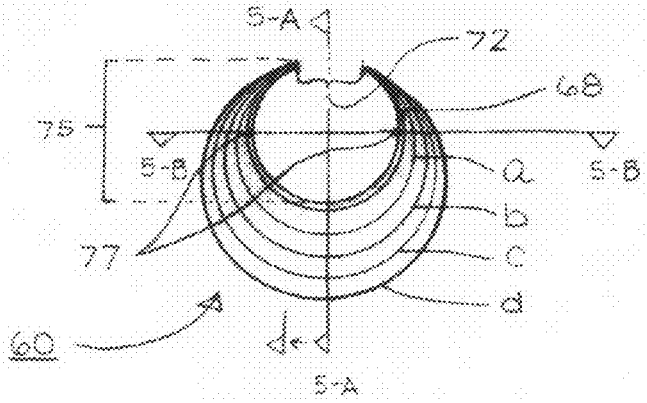
FIG. 5-C

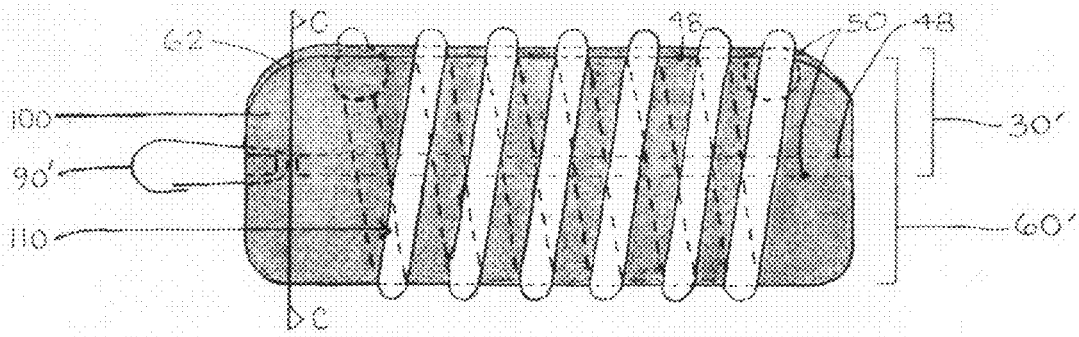
FIG. 1'-A
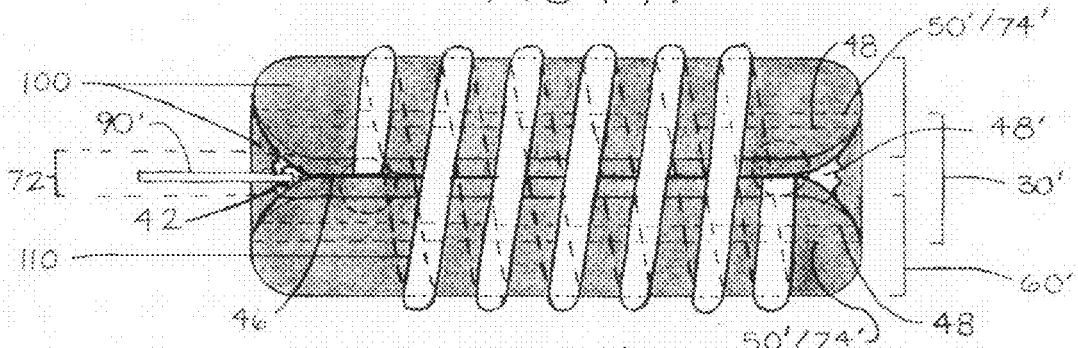
FIG. 1'-B
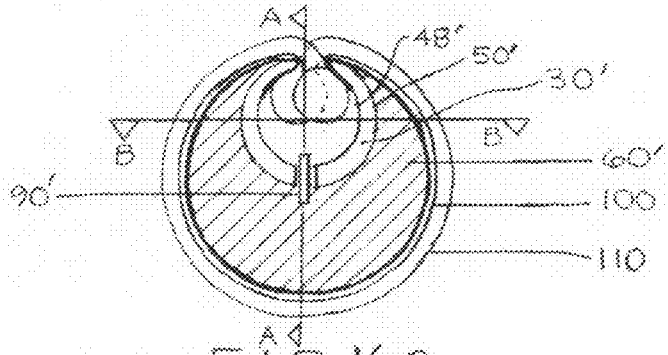
FIG. 1'-C

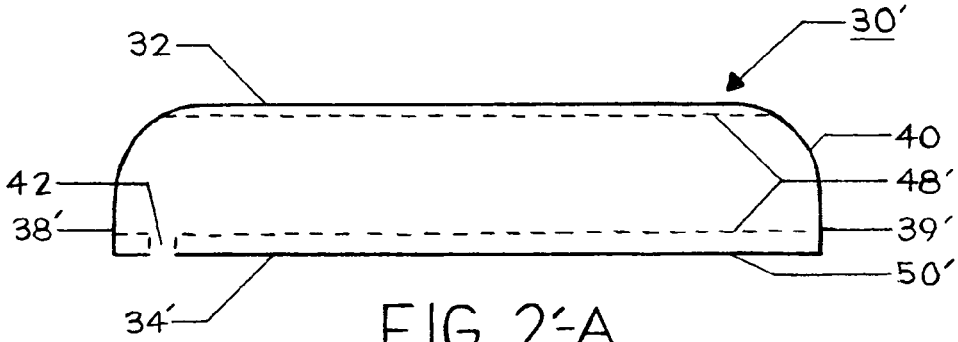
FIG. 2′-A
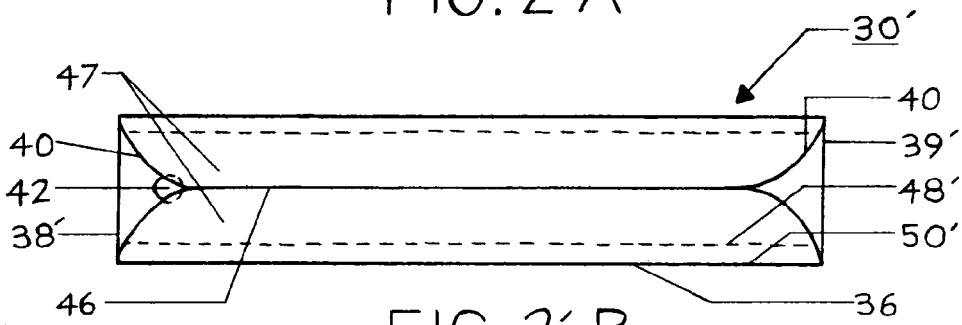
FIG. 2′-B
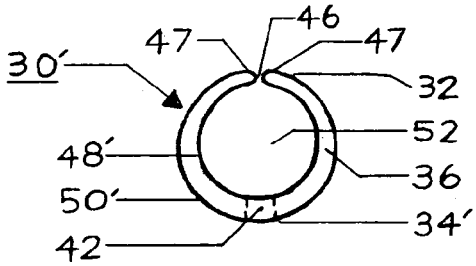
FIG. 2′-C
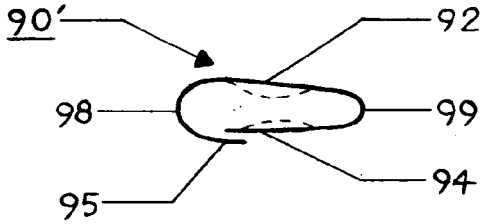
FIG. 4′-A
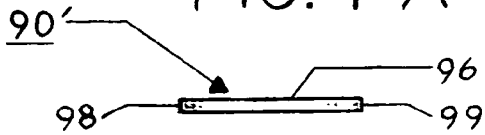
FIG. 4′-B

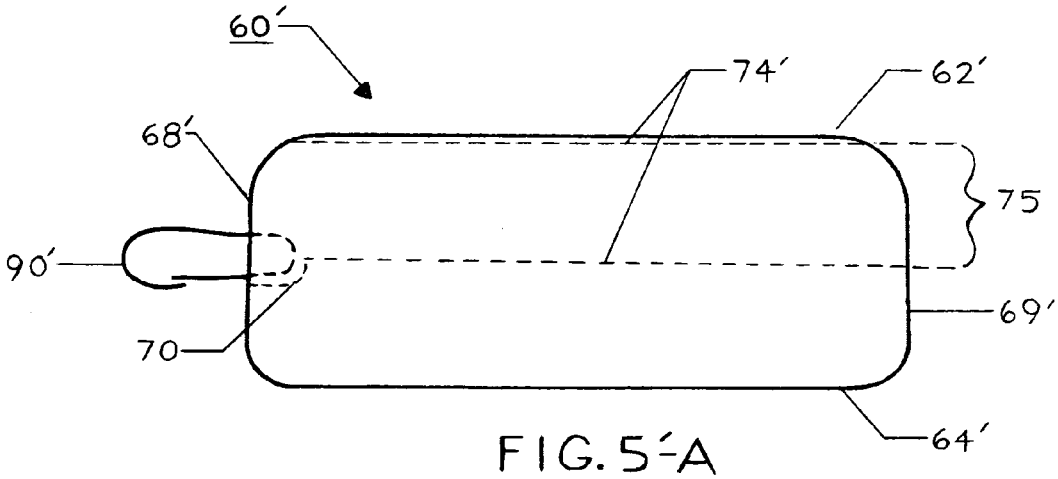
FIG. 5′-A
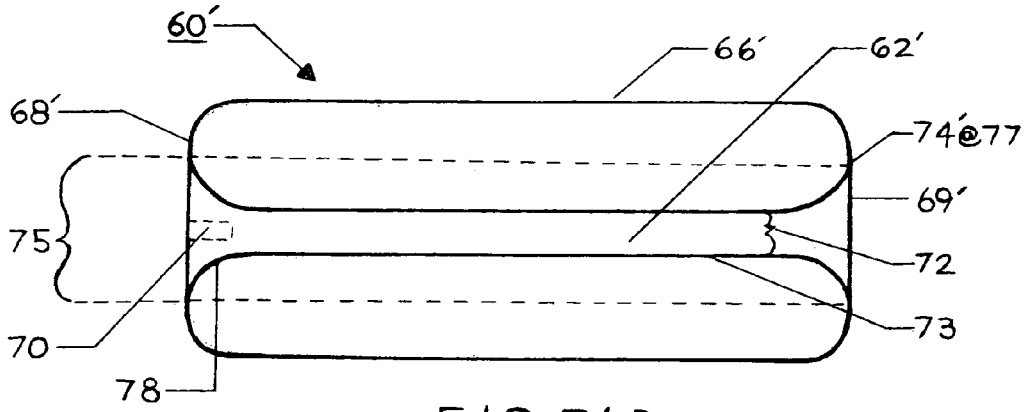
FIG. 5′-B
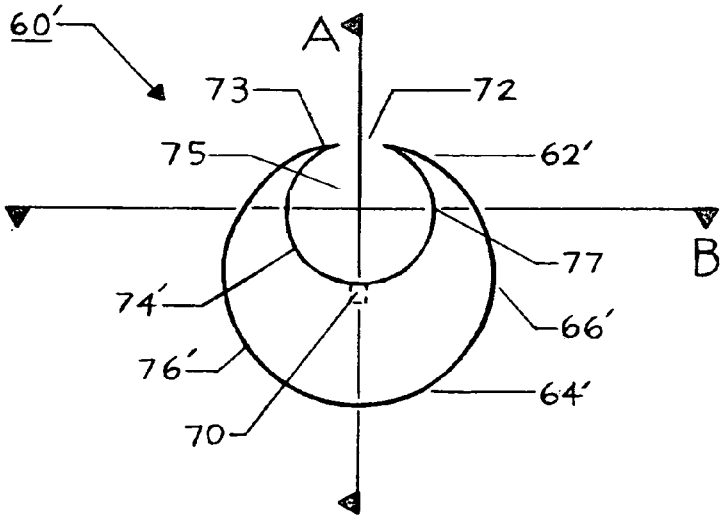
FIG. 5′-C

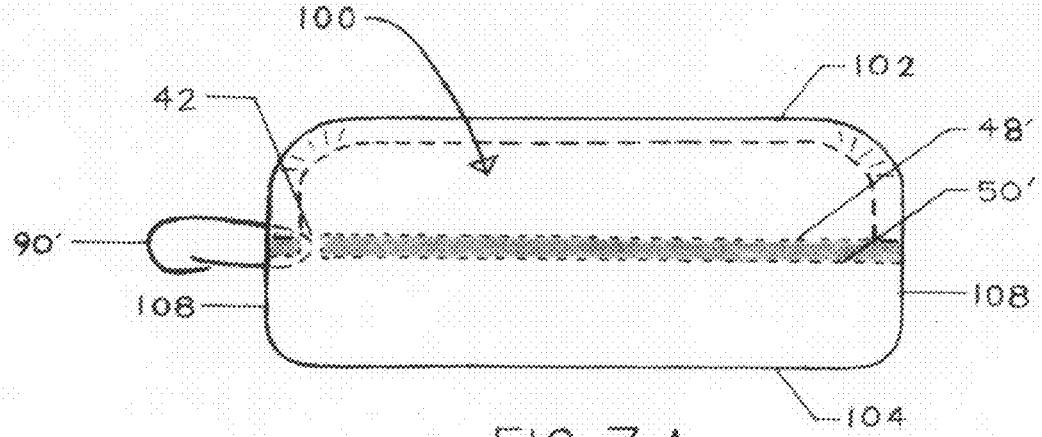
FIG. 7-A
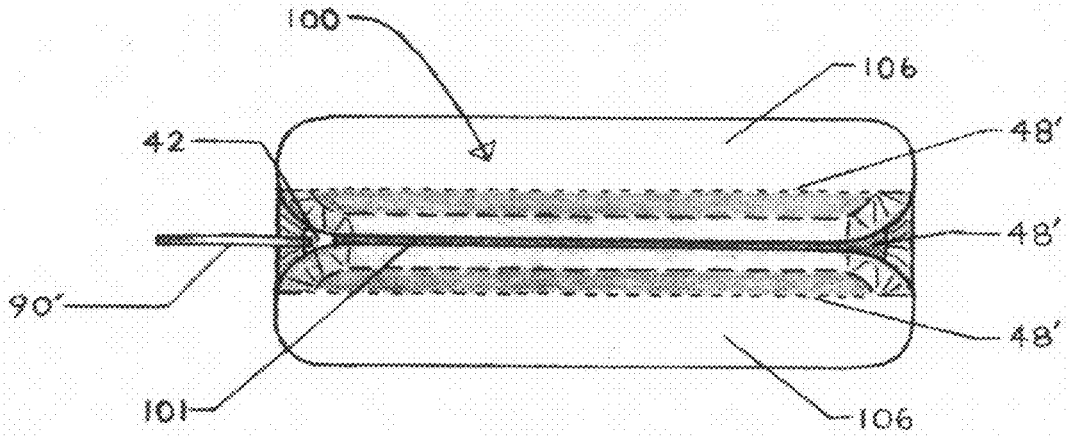
FIG. 7-B

ERGONOMIC HANDLE TO CARRY PLASTIC SHOPPING BAGS

CROSS-REFERENCE TO RELATED APPLICATION

This application is entitled to the benefit of Provisional Patent Application Ser. No. 60/342,303 filed Dec. 21, 2001.

FEDERALLY SPONSORED RESEARCH

Not applicable

SEQUENCE LISTING OR PROGRAM

Not applicable

BACKGROUND

1. Field of Invention

The present invention relates to a readily applicable and removable handle for plastic grocery bags and grocery baskets, and more particularly to a handle which is especially comfortable in use, remains on the handles of the shopping bags when the bags are set down, and has an additional means to help keep all the items in the bags.

2. Prior Art/Problems

It is a common practice of grocery stores to provide bags to their patrons, so they may transport their purchases home. Most often the bags supplied are made of very thin plastic. These bags have a loop formed in the top portion on each side. These loops are meant to supply a crude handle, whereby one inserts one's hand in the recesses of both loops, and may carry the bags home.

Problem #1: [Pressure concentrated on only 2 fingers] To avoid pinched knuckles, most people carry bags with only 2 fingers. This doubles the load on the remaining fingers and puts even more pressure on the knuckles, reducing blood flow in the fingers even more.

Some handles are not rigid, so the handle bends down at the ends, pinches the knuckles, and puts all the pressure on two fingers.

Problem #2: [Pressure concentrated on the knuckles of the fingers] These bags have loops of very thin material. When a loaded bag is grasped, the fingers curl to retain it. This curling of the fingers forms a "V" at the top of each of the middle knuckles. The handles then settle in the bottom of this "V". This causes the handles to condense to form a thin strand. When carried, these thin strands concentrate the load over a very small area of the middle knuckles of the hand. When the bag is heavily loaded, this concentrated load puts a lot of pressure on the knuckles. This reduces blood flow in the fingers, which causes pain and numbness in the fingers.

Some handles are not very thick (and/or rigid) so the weight is still concentrated on the knuckles Problem #3: [Knuckles being pushed together] When a bag is very heavily loaded, the loops of the bag handles want to hang straight down from whatever they are hanging from. When one puts their hand in the recess of the loops, this forces the loops apart. The loops then counteract with an opposing force, to minimize the distance between the handles. This opposing force tends to squeeze the knuckles of the hand together, which can be very painful. This inward force is particularly painful for the index and pinkie finger. Consequently, what people usually do is to carry the bags with only the ring and middle finger.

Some handles are not very thick (and/or not rigid) so the weight of the bags still pulls the handle down at the ends, which pushes the knuckles together.

Problem #4: [A need to keep all of the plastic bag handles together] As one is leaving the checkout stand, one has to dig through a tangle of handles to pick up all the bags. Every time one sets these bags down, one has to go through this process to retrieve them all over again. Many people may need to set the bags down at least several times on their way home-such as when they put the bags in their car; or when they get to their door, (and have to retrieve their keys). [There have been many times I have thought I picked up every handle of the bags. Then I discovered that one was missing, and the contents of that bag spilled all over the ground, breaking any bottle it contained.] Even if one does find every handle, it is time consuming and irritating, especially if one has to keep setting the bags down because the handles hurt as one is walking home.

Some other bag handles have a way to support the weight of the bags, but these handles do not stay on the plastic bag handles when the groceries are put down (no locking mechanism).

Problem #5: A desire to keep multiple handles of grocery bags together in one grip.

Some bag handles do not have a very big storage area for handles, so they don't accommodate many handles well.

Problem #6-A: A desire to find a way to keep all the contents in the bag—a way to restrict the neck of the bags. All of the handles (that have a way to keep all the plastic bag handles together) tend to stay affixed to the Top of each of the handles of the plastic bags. While it is an advantage to keep all of the plastic bag handles together, this does nothing to close the large openings in the 'necks' (opening in each loop) or 'mouth' (main opening of the bags) of the plastic bags.

Even when the bag handles are kept together in one handle, it may still be possible for the bag(s) to tip over. The necks of the bags are larger (necessarily must be) than the items that are put in it. So if the bag tips over, and the items are smaller (necessarily must be) than the neck of the bags, they may fall out of the bags. This is especially a problem when the bags are in the trunk of a car (or on the seat of a car), and are jostled by the movement of the vehicle. Small round items (such as fruit) are particularly prone to roll out of the bags so jostled.

NO OTHER PRIOR ART I HAVE COME ACROSS EVEN MENTIONS THIS PROBLEM, LET ALONE ADDRESSES IT.

"OK (you may ask), why not just tie the loops together at the top to prevent items from coming out of the necks/mouth of the bag? You would be correct, this would be one way to keep the items in the bags. However, when one ties the loops together at the top, the (knot of the tie) is only able to go down the necks a certain amount. This often leaves pockets of trapped air inside the bag, so small items at the bottom of the bag can still move around, and food containers can tip to the side. [If food containers tip to the side they are likely to spill sauce on the bottom of the bag—and, if there is a hole in the bag—on the person carrying the bag.] This trapped air in the bags leads to Problem#6-B . . .

Problem #6-B: [Find a way to keep items from moving around in the bag.] Find a way to minimize items (such as glass bottles or very small items) from hitting each other; or food containers (like those for Chinese food) from popping open or turning over.

NO OTHER PRIOR ART I HAVE COME ACROSS EVEN MENTIONS THIS PROBLEM, LET ALONE ADDRESSES IT.

Problem #7: [Way to keep keys accessible] I don't know about anyone else, but I have a bad habit of putting my key ring on one of my fingers (or in my hand), then picking up the handles of the bags. I do this at the checkout stand-as I will need the keys handy to get into my car. I also do this when I put the bags in my car- to avoid leaving my keys in my trunk. I usually need two hands to gather all of the bag handles together, and to carry all of the bags. This means that when I get to my car and to my door, I must put all the bags down to retrieve my keys. [Once again I must sift through the tangle of bag handles to carry them inside!]

Some handles have a way to attach a key ring to the handle, but it is not necessarily easy to attach and detach the key ring from the handle, leading to problem #8.

Problem #8: One could attach a key ring directly to a handle that is used to carry loaded plastic grocery bags. The problem with that is—that when a handle is used to keep the bag handles together, the handle should logically be left on the handles when the bags are put in the trunk of one's car. Since one needs the keys to start one's car, the key ring must be detached from the handle every time one puts bags in one's trunk. If one has many keys on their key ring, (or if the means to attach the key ring to the handle is very thick), this could take awhile, and become tedious very quickly.

I HAVEN'T SEEN ANY PRIOR ART THAT MENTIONS OR ADDRESSES THIS PROBLEM.

OBJECTS AND ADVANTAGES

Accordingly, several objects and advantages of my invention are:

1. To provide a handle that helps to distribute the weight of the bag or basket amongst the four parallel fingers of the carrying hand.

2. To provide a handle that helps to distribute the weight of the bag or basket over a longer area of each finger and prevent downward pressure on the knuckles.

3. To provide a handle that prevents the knuckles of the carrying hand from being pushed inward-against one another.

4. To provide an ergonomic handle that keeps the handles of plastic grocery bags together, so that when the bags are set down, one may retrieve the entire load (more quickly and easily) by picking up only one handle.

5. To provide an ergonomic handle that holds multiple handles of grocery bags in one grip.

6. To provide an ergonomic handle that has features to help keep the contents in the bags.

7. To provide an ergonomic handle that keeps keys accessible when carrying loaded bags.

8. To provide an ergonomic handle that is easily attached to and detached from a key ring.

9. To provide an ergonomic handle that includes various means of transporting same, to keep it with you whenever you need it.

10. To provide an ergonomic handle with various means for storage, to help keep it visible so you will remember to take it with you (when you leave the house or car)

11. To provide an ergonomic handle that is designed to prevent it from cutting or otherwise hurting the hand of the user.

12. To provide an ergonomic handle that is designed to prevent it from damaging the handles of the grocery bag.

13. To provide an ergonomic handle that accommodates various size hands and fingers with one size grip.

14. To provide an ergonomic handle that anchors the bags together at the top-to help prevent the bags from turning over and spilling their contents.

15. To provide an ergonomic handle that anchors the bags together—to minimize lateral movement in a moving vehicle.

16. To provide an ergonomic handle that provides cushioning—which helps to absorb the shock of the load (as the load bounces up and down when one is walking).

17. To provide an ergonomic handle that has an adjustable surface—which helps the handle to conform to the specifics of each user's hand.

18. To provide an ergonomic handle that has a comfortable grip.

19. To provide an ergonomic handle that is durable.

20. To provide an ergonomic handle that is reusable.

21. To provide an ergonomic handle that is small enough to be easily portable.

22. To provide an ergonomic handle that is easily attachable to plastic grocery bags.

23. To provide an ergonomic handle that is easily detachable from plastic grocery bags. (Some of the prior art handles are easy to attach but not as easy to detach.)

ADDITIONAL OBJECTS AND ADVANTAGES OF MY INVENTION ARE

24. To provide an ergonomic handle that has the most cushioning at the bottom, where it is needed the most.

25.To provide an ergonomic handle that has a means to store the bag restricting means on the handle itself, to keep everything together.

26. To provide an ergonomic handle that includes a means to keep a key ring (with keys on it) handy when it is detached from the grip.

27. To provide an ergonomic handle, the bottom of which conforms more readily to the natural convex curvature (of the alignment of the middle knuckles of the fingers) of the hand in a grasping position.

28. To provide an ergonomic handle which conforms more readily to the natural lengthwise curve of the fingers in a grasping position.

29. To provide an ergonomic handle that is designed to give support to the palm—that encourages the use of the whole hand in gripping, possibly helping to distribute the stress away from the hand, and more toward the forearm and biceps.

30. To provide an ergonomic handle that may help alleviate stress/tension by squeezing the soft, resilient foam casing repeatedly with the hand.

31. To provide an ergonomic handle that actually functions—(not just sounds good in theory).

SUMMARY

My invention is an ergonomic handle that is used for carrying plastic grocery bags and baskets. The ergonomic handle comprises a combination of some (or all) of the following parts: inner modified tubular structure, (an optional) foam casing, (an optional) connector, (an optional) clip, (an optional) cover (of fabric or other materials), (an optional) spring/ring/or band, and (an optional) key ring. The handle is mainly designed for comfort to the user and to hold all the bags together. In the preferred embodiment, the handle also solves all of the aforementioned problems (that existed prior to this device), and has the additional advantages listed above.

DRAWINGS

Drawing Figures-Notes . . .

The first few pages (1-4) of drawing figures show the preferred embodiment of the handle.

The entire handle is viewed from various angles. I then break down the handle into its' component parts, and show several views of each part. I start with the innermost part, as that is the most essential part. I then subsequently work my way outward.

The preferred embodiment is very similar to the original/alternate embodiment. The preferred embodiment will be described first, and the original/alternate embodiment will be described (in further detail) next.

The next few pages (5-9) of drawing figures show the original, alternate embodiment of the handle. Once again, the entire handle is shown, then each of the individual parts. If a particular part of this alternate embodiment has already been shown in the preferred embodiment, but differs in some way, then the number of that part is followed by prime notation (').

The following page (10) of drawing figures shows necklace (160) attached to modified tubular structure (30). The last page (11) of drawing figures shows 2 alternate combinations of elements, in which the band is used to attach either a set of keys on a key ring to a doorknob, or the handle assembly to a doorknob.

I did not enclose any perspective drawings, because the front, top, and end views show the elements of the handle more clearly.

Notes Regarding the Drawing Figures:

The drawings are done at (or very close to) scale, except for the figures specifically showing detail.

The different numbers of the figures generally relate to the different parts of the handle.

The different letters of the figures correspond to the different views of these parts.

The views are in the same order (either top to bottom or left to right) for each part.

End and section views will be taken from the left side.

Changes to specific parts are denoted by prime notation (') following the number.

Changes to specific views are denoted by prime notation (') following the letter. End views and section views may be similar. The end view may be denoted by "C" and the section view denoted by "C'" (prime notation). Some views may show a combination of views—such as side/section, top/section, and end/section. This is done to show the relationship of the inner and outer surfaces, or the relationship of individual parts to one another. These views will not use prime notation, but use the letter of the primary view.

Dashed lines will be used to indicate inner and/or outer surfaces of parts.

Shading will be used to differentiate various parts from one another (FIGS. 1-A, 1-B, and 1-C), or to differentiate the inner surface from the outer surface of the same part (FIG. 5-B)

Shading is also used to help convey the shape of the part-especially curves. Darker areas are usually further away (FIGS. 6-B, 6-C, and 6-C'). In some cases (see FIGS. 2-C and 2-E) the darkest areas are used to show a dramatic curve (away from the viewer), and lighter areas are used to show a subtle curve.

DRAWING FIGURES-LIST

Preferred Embodiment

Page 1 FIG. 1-A Side view of the assembled parts of the ergonomic handle.

FIG. 1-B Top view of the assembled parts of the ergonomic handle.

FIG. 1-C End view of the assembled parts of the ergonomic handle.

Page 2 FIG. 2-A Side view of the inner (plastic) tube.

FIG. 2-B Top view of the inner (plastic) tube.

FIG. 2-C End view of the inner (plastic) tube.

FIG. 2-E Detail of the end view of the inner (plastic) tube.

Page 3 FIG. 3-A Side view of preferred connector (Jump Ring)

FIG. 3-B Top view of preferred connector (Jump Ring)

FIG. 3-C End view of preferred connector (Jump Ring)

FIG. 3'-A Side view of alternate connector (split ring)

FIG. 3'-B Top view of alternate connector (split ring)

FIG. 3'-C End view of alternate connector (split ring)

FIG. 4-A Side view of the clip (metal lanyard hook).

FIG. 4-B Top view of the clip (metal lanyard hook).

FIG. 4-C End view of the clip (metal lanyard hook).

FIG. 6-A Side view of the elastic band.

FIG. 6-B Top view of the elastic band.

FIG. 6-C' Section view of the elastic band.

FIG. 6-C End view of the elastic band.

Page 4 FIG. 5-A Side View of the foam casing.

FIG. 5-B Top View of the foam casing.

FIG. 5-C End view of the foam casing.

DESCRIPTION

Original/Alternate Embodiment

Page 5 FIG. 1'-A Side view of the assembled parts of the ergonomic handle.

FIG. 1'-B Top view of the assembled parts of the ergonomic handle.

FIG. 1'-C End view of the assembled parts of the ergonomic handle.

Page 6 FIG. 2'-A Side view of the inner (plastic) tube.

FIG. 2'-B Top view of the inner (plastic) tube.

FIG. 2'-C End view of the inner (plastic) tube.

FIG. 4'-A Side view of modified clip (metal lanyard hook)

FIG. 4'-B Top view of modified clip (metal lanyard hook)

Page 7 FIG. 5'-A Side view of intermediate foam casing

FIG. 5'-B Top View of the intermediate foam casing
FIG. 5'-C End view of the intermediate foam casing Page 8 FIG. 7-A Side view of optional outside cover (fabric).
FIG. 7-B Top View of the optional outside cover (fabric).

Figure 8B:
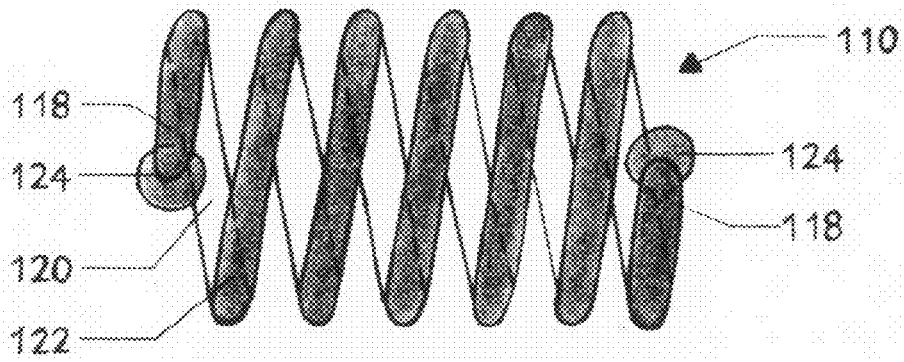
Figure 8C:
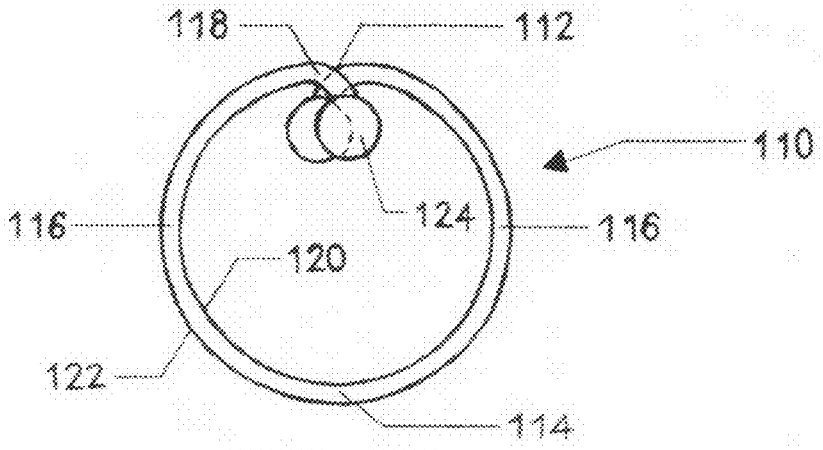

Page 9 FIG. 8-A Side view of the spring.
FIG. 8-B Top view of the spring.
FIG. 8-C End view of the spring.

Figure 10A:
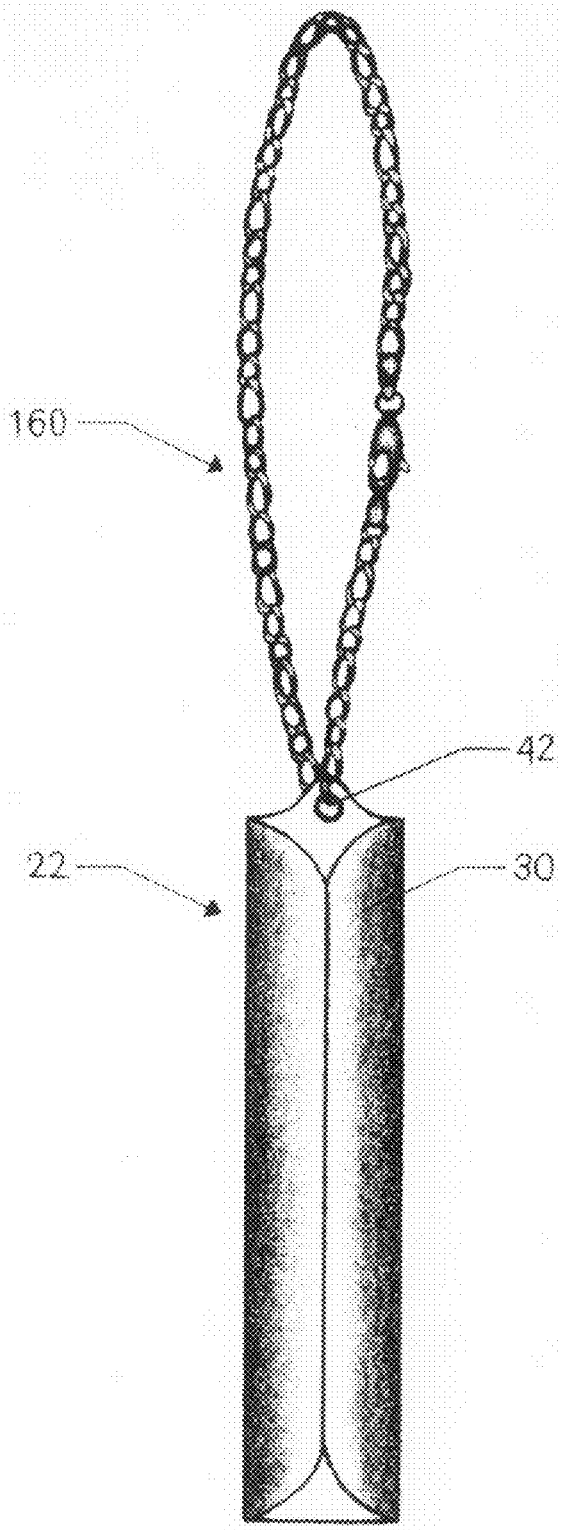

Page 10 FIG. 10A Top view of the inner (plastic) tube and necklace.

Figure 11A:
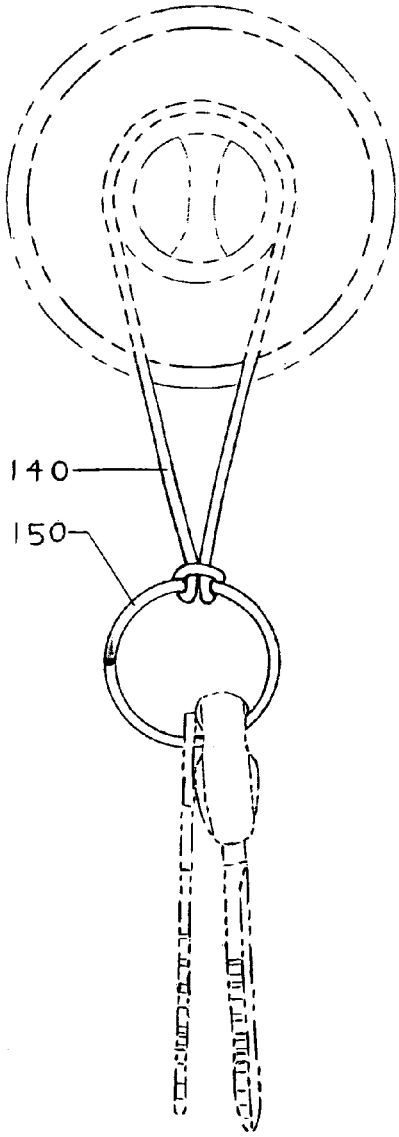
Figure 11B:
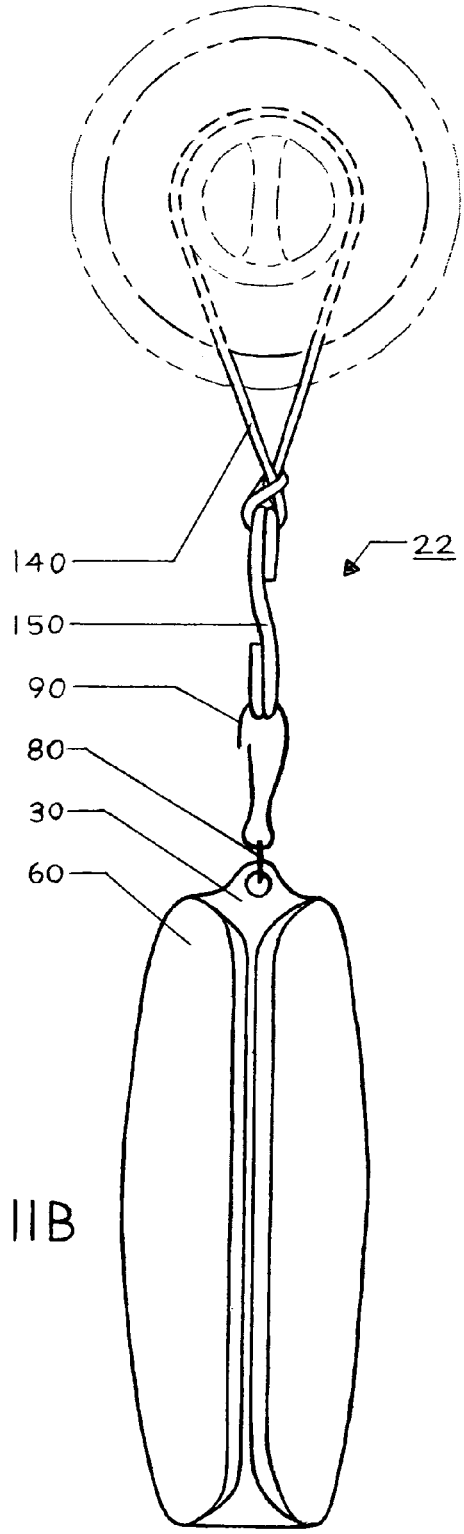

Page 11 FIG. 11A Front View of the key ring with keys and band
FIG. 11-B Top view of handle with key ring and band

REFERENCE NUMBERS IN DRAWINGS

22 ergonomic handle—preferred embodiment
22' ergonomic handle—original/alternate embodiment
24 recess in neck of plastic bags
26 plastic bag
28 plastic bag handles
30 modified tubular structure (tube)
32 top of tubular structure
34 bottom of tubular structure
36 sides of tubular structure
38 first (left) end of tubular structure
39 second (right) end of tubular structure
40 fillet
42 hole
44 (protrusion) tab
46 slit
47 sides of slit (the long cut edges of tube)
48 inner surface of tubular structure
49 rounded edge
50 outer surface of tubular structure
52 bore
54 longitudinal axis of bore
55 vertical offset
56 longitudinal axis of outside of tubular structure
58 midpoint of side
60 foam casing
62 top of foam casing
64 bottom of foam casing
66 sides of foam casing
67 longitudinal center of foam casing
68 first end of foam casing (or both ends if they are identical)
69 second end of foam casing
70 notch at end of foam casing
72 gap at top of foam casing
73 sides of gap (long edges of foam casing)
74 inside of foam casing
75 bore
76 outside of foam casing
77 vertical midpoint of bore at sides (of ends)
78 fillets
80 preferred connector (jump ring)
82 top of connector
84 bottom of connector
86 sides of connector
88 ends of connector
80' alternate connector (split ring)
82' top of connector
84' bottom of connector
86' sides of connector
88' ends of connector
90 clip (metal lanyard hook is preferred)
92 top of clip
94 bottom of clip
95 opening of clip
96 side(s) of clip
97 neck of clip
98 (left) tall end of clip
99 (right) short end of clip
100 optional (fabric) cover
101 gap (between sides of cover)
102 top of cover
104 bottom of cover
106 sides (long edges) of cover
108 ends (short edges) of cover
110 outermost spring
112 top of spring
114 bottom of spring
116 sides of spring
118 ends of spring
120 inner surface of spring
122 outer surface of spring
124 "Pea-shaped" termini of spring
140 elastic band (hair band preferred)
142 top (?) of band
144 bottom (?) of band
146 sides (?) of band
148 ends of band
150 key ring (large split ring)

{Key ring 150 is a larger version of alternate connector 80'-but in this context it is used for holding keys, rather than as a connector}
160 necklace

DETAILED DESCRIPTION

Description

Preferred Embodiment

Page 1

FIGS. 1-A, 1-B, and 1-C show several views (top, side, and end) of the preferred embodiment of the assembled handle 22. The handle 22 consists of several basic parts: an inner modified tubular structure (tube) 30, a connector (jump ring) 80, a clip (such as a metal lanyard hook) 90, a foam casing 60, and an elastic band 140. (I may also want to include a standard key/split ring 150).

{Differences between embodiments: The preferred embodiment (P.E.) adds a protrusion/tab 44 to one end of the tube 30 for the location of hole 42. The P.E. also adds a connector 80, and substitutes an elastic band 140 in lieu of spring 110. The P.E. eliminates optional cover 100.}

The foam casing 60 is show shaded in all 3 views to distinguish it from the (non-shaded) modified tubular structure (tube) 30. In FIG. 1-A, the double set of dashed lines that run the length of tube 30 are used to show how tube 30 relates to foam casing 60. The dashed lines show inner 48 and outer 50 surfaces (as in longitudinal section) of tubular structure 30. In FIG. 1-B, the dashed lines show outer surface 50 of tubular structure 30. In FIGS. 1-A and 1-B, elastic band 140 is shown wrapped twice around the center of foam casing 60 for storage, and in FIG. 1-C it is shown attached to clip 90 for storage.

Interconnections: Tube 30 has a tab 44 at end 38. This tab 44 has a hole 42 which provides a means to attach connector 80 (or clip 90 directly) to tube 30. Connector 80 provides an intermediate/alternate means to attach clip 90 to tube 30. Foam casing 60 (which surrounds and encases tube 30) will most likely be attached to tube 30 with some kind of adhesive, heated plastic, friction fit, or other means known by those skilled in the art. Elastic band 140 may be stored on the handle by attaching it to clip 90, or by wrapping it around the center of foam casing 60 of the handle. Optional key ring 150 may be attached to clip 90 (preferred attachment), to connector 80, or to tube 30.

Page 2

Description—FIGS. 2-A, 2-B, 2-C, and 2-E show different views of the first component, the (inner) modified tubular structure 30. The inner core of the hand-grip comprises an elongated, modified tubular structure 30. It is intended to be used in a horizontal position. It is designed to be made of a suitable type of plastic. The type of plastic used would preferably be mainly rigid, but would have some flexibility.

A large bore 52 extends longitudinally through the tube from end to end. In a preferred embodiment, the longitudinal axis of the bore 54 is eccentric (slightly off-center) to the longitudinal axis of the tube 56. The offset is slight, and the direction of the offset is towards the top of the tube. Having offset axes creates differing widths of the material. The thickness of the material of the tube reaches a maximum on the bottom 34, and a minimum on the top 32. The thickness of the material at the sides 36 slowly decreases from the maximum at the bottom 34 to the minimum the top 32.

There is a slit 46 cut longitudinally along the top 32 (the side with minimum thickness), from end to end of the tube. This slit 46 is perpendicular to the ends 38 of the tube (as viewed from the side or top). The opposing sides 47 of the slit 46 may be in direct contact with one another, or there may be a slight gap between each other.

There are two fillets 40 on each end 38&39 of tube 30. Each fillet 40 has the shape of a quarter circle, and is used to round edges (the convex portion faces out). The fillets 40 start at the midpoint 58 of each side 36 (of each end 38/39) and meet at slit 46 at top 32. The fillet 40 is made with a radius of not more than ½ the height (outer diameter) of the tube. [If the tube were opened up and laid flat, it would look like a rectangle—with each corner rounded. The long sides of the rectangle are next to one another when it is rolled up to form the tube shape, and form the sides 47 of slit 46.]

Ideally, the perimeter edges of both the inside and outside surface of the tube are rounded or beveled. These edges may be filleted with a radius (between 1/32' and 3/32") of approximately one-half the thickness of the material (1/16" to 3/16"). These rounded/filleted edges are shown in FIG. 2-C and FIG. 2-E. These figures show only the sides 47 of slit 46 as being rounded, but ends 38 and 39 and fillets 40 (of tube 30) would be rounded as well. [Referring to my description of a flattened tube in the previous paragraph, liken this flattened tube to a mattress—all 4 corners are rounded, and the sides are rounded all the way around on the top and bottom.]

Page 3

Description—FIGS. 3-A, 3-B, and 3-C show the side, top, and end views of the preferred connector 80—a Jump Ring. These views show the Jump ring approximately to scale. These rings are common articles of manufacture. Western Trimmings Corporation (of Chatsworth, Calif.) is one manufacturer. These rings are very small—the one I show is only ¼" in diameter. [They are mainly used to make jewelry—such as necklaces. They are usually used to connect the ends of a necklace to the (even smaller) rings on each end of a clasp (such as a "Torpedo Clasp" or "Etch Barrel clasp (2 Loop)".] They are very thin, made of metal, have a ring shape, and are cut at one 'side'. This cut may be spread apart, to allow the ring to be attached to other objects (such as a "Torpedo Clasp"). The cut ends are then pushed back together (perhaps with needle-nose pliers) to keep these two objects together. I like to use connector 80 between tube 30 and clip 90, because it easier to attach (than clip 90 or alternate key ring 150) to hole 42 in tab 44 (of tube 30).

Description—FIGS. 3'-A, 3'-B, and 3'-C show the side, top, and end views of an alternate connector 80'-a Split Ring. These views show the Split Ring approximately to scale. These rings are common articles of manufacture. Western Trimmings Corporation (of Chatsworth, Calif.) is one manufacturer. These rings are very small—the one I show is only ¼" in diameter. They are mainly used to make jewelry—and function much the same as a Jump Ring.

These Split Rings are usually called key rings when they are larger (large enough to accommodate 1 or more keys). They look similar to Jump Rings, but instead of 1 revolution of a circle, they have almost 2 revolutions. A Split Ring is a spiral, whereas a Jump Ring is a circle. The cut ends are offset from one another. I prefer a Jump Ring to a Split Ring, as the former seems easier to attach (to hole 42 in tab 44 of tube 30).

Description—FIGS. 4-A, 4-B, and 4-C show the side, top, and end views of clip 90. A Metal Lanyard Hook is preferred for the clip 90, but other clips could be use as well. These views show the clip approximately to scale.

In FIG. 4-A, (side view) one can see the neck 97, opening 95, left (wide) end 98, and right (narrow) end 99, as well as the top 92 and bottom 94 of clip 90.

In FIG. 4-B, (top view) the dotted line at the left shows where the opening 95 is located on the bottom 94. The shading and faint vertical lines at the right are used to show the location of the neck 97. The darkest area of the shading indicates the portion of the neck that is furthest away in this view. In the case of the vertical lines, lines that have more spacing between them are used to show a gradual slope of the material, and lines that have less spacing between them are used to show a steeper slope (greater rate of change in height).

In FIG. 4-C, (end view) the shading at the top and bottom is used to show that these edges are receding in this view (i.e. the surface is curved). The faint horizontal lines function similarly to the lines in FIG. 4-B—lines that are closer together (as at the top and bottom) indicate a sharper curve.

Description—FIGS. 6-A, 6-B, and 6-C show the side, top, and end views of elastic band 140. These views show the elastic band approximately to scale. The elastic band I normally use is an elastic hair band, but a rubber band or other flexible bands could be used as well. Basically any brand of elastic hair bands should work, as long as they can expand to at least 1¼" in diameter.

Band 140 may be stored on the handle, by expanding it around the center of foam casing 60. If the band 140 chosen can expand to 2½" or more in diameter, it may be wound 2 or more times around the center of the foam casing 60 for storage (see FIGS. 1-A and 1-B).

Band 140 may also be attached to clip 90 (or even to connector 80 or key ring 150) for storage (see FIG. 1-C).

Page 4

Description—FIG. 5-A shows the side view of foam casing 60. Shading is used to show the outside 76 of foam casing 60. Darker areas of shading indicate more pronounced curves. The dashed lines indicate the top and bottom portions of inside surface 74 (of foam casing 60). [These edges would be seen in a longitudinal sectional cut through the top 62 and bottom 64 (of foam casing 60) taken parallel to section line '5-A' in FIG. 5-C.] The relative position of the inner and outer surfaces is important to understanding the thickness of the material at various locations. As one can see in this figure, the foam casing is thinner at top 62, and thicker at bottom 64. The bottom 64 (of foam casing 60) is rounded into a convex shape. It is thickest at the bottom center and somewhat thinner at the bottom ends. The foam tapers from the center towards each end.

Description—FIGS. 5-B shows the top view of foam casing 60. The outer surface 76 is shown shaded, and the inner surface 74 is not shaded. In this preferred embodiment, there is no notch 70 (as exists in the original embodiment) in the foam casing at the end. Since both ends are identical, they are each referred to by number 68. The dashed lines indicate the inner surface 74 (of foam casing 60) at the widest point (vertical midpoint 77) of bore 75—as seen from above. [These edges of the inner surface would be seen in a longitudinal section cut that is taken through the vertical midpoints 77 of bore 75 (see section line '5-B' in FIG. 5-C).]

There is a gap 72 (in foam casing 60) that runs the length of foam casing 60 at the top 62. Gap 72 is about ¼" wide. [The sides 73 of gap 72 will be aligned with (but set back from) the slit 46 of tube 30 when the handle is assembled.] There are fillets 78 at each end 68 (of gap 72), on each side 66. [These fillets 78 will be aligned with (but set back from) the fillets 40 of tube 30 when the handle is assembled.]

As can be noted in this view, the sides 66 of foam casing 60 are also convex (on the outside) like the bottom 62, but the convex curve is flatter.

Description—FIGS. 5-C shows the "end" view of foam casing 60. This end view is really a series of layered section views. I used this method to convey the laterally convex shape of (the outside of) foam casing 60, as it exists all the way around bore 75. The rings correspond to the section lines a, b, c, and d in FIG. 5-A. The greater the distance between the rings, the steeper the slope of the arc (convex curve). The bottom 64 is very curved, the sides 66 are somewhat curved, and the top 62 is very slightly curved.

The ends 68 of foam casing 60 are sharply rounded, whereas the center of foam casing 60 tapers gradually.

Key Ring 150.

The key ring 150 is a large Split Ring. The key ring is optional—most people have one already. I have included a description and several drawings of a smaller size split ring (to be used as a connector 80). I did not feel it was necessary to include a separate drawing for the larger version. Also, most everyone knows exactly what it is and what it looks like. The important thing here is that when a key ring is used in conjunction with the ergonomic handle 22, it may be attached directly to tube 30, or to connector 80, or to clip 90.

How to Make the Preferred Embodiment

How to Make the Tube:

Materials: The tube will most likely be made of some kind of plastic. Ideally, the tube would be made of a material that is similar (or identical) to "Friendly Plastic". The tube may also be made of poly-ethylene-tere-phthalate (PET), polyethylene, polypropylene, hard rubber, or any other similar (suitable) materials. The type of material chosen should be rigid (but should be flexible enough to bend—not break—when bent slightly). The thinness of the material and circular cross-section shape of the tube 30 may provide the flexibility needed.

Ideally, the material would be between 1/16" and 3/16" thick, if it is plastic. The length of the tube should be about 4". The inner diameter of the tube should be about 5/8". The outer diameter of the tube should be about 13/16".

Methods: The tube 30 will probably be made with an injection mold or molds. These molds would most likely be designed using CadCam or MasterCam software programs. The tube 30 could also be made with conventional multi-part molds of a suitable material. The tube 30 would most likely have: protrusion 44, hole 42, slit 46, fillets 40, bore 52 and rounded edges 49 of the inner 48 and outer 50 surfaces formed as part of the casting process.

How to Make the Foam Casing:

Materials: The foam casing 60 will (surprise!) be made of some kind of resilient, flexible foam. I would like to use a material similar (or identical) to the foam used by XONEX INTERNATIONAL (of Cleveland, Ohio) to make their "PENCIL GRIPPERS". Many other resilient-flexible foams could be used, this is just one possibility used to illustrate the type of material I would like to use. Ideally, I want to use a type of foam that will be soft and spongy, yet durable. It should be resilient—it should be able to condense some amount with pressure, and then return to its original shape when the pressure is removed. The foam should also be easy to clean, or at least not show dirt or grease marks. It should not be brittle or prone to breaking or snagging. The foam could be made of any color, or multicolored.

Methods: The foam casing 60 will also probably be made with an injection mold or molds. These molds may be designed using CadCam or MasterCam software programs. The foam casing 60 could also be made with conventional multi-part molds of a suitable material.

The connector 80—(such as a Jump Ring or Split Ring) already exists, and is well known to those skilled in the art.

The clip 90—(such as a Metal Lanyard Hook) already exists, and is well known to those skilled in the art.

The elastic band 140—(such as a hair band or rubber band) already exists, and is well known to those skilled in the art.

The key ring 150—(such as a large Split Ring) already exists, and is well known to those skilled in the art.

The connector 80, clip 90, elastic band 140, and key ring 150 may be purchased prefabricated, and assembled to the other parts. This assembly is described under the "interconnections" paragraph in the detailed description listed previously.

Operation

Of Preferred Embodiment

Part 1

How individual parts of the ergonomic handle work to provide the "advantages"

(The following is a list of the Objects and Advantages listed previously, plus a recitation of the particular parts or design elements that make it happen. The means to accomplish the function is written in bold Italics)

Accordingly, some objects and advantages of my invention are:

1. To aid distribution of the weight of the bag or basket amongst the four parallel fingers of the carrying hand. (The length and rigidity of tube, bore, slit. These work together to transfer the pressure to the ends of the tube)

My solution: create a rigid handle that is as long as the palm of the hand. The length (of this rigid support structure) will distribute the weight over all four fingers.

2. To aid distribution of the weight of the bag or basket over a longer area of each finger and prevent downward pressure on the knuckles. (Circular cross-sectional design, rigidity and width of tube, circular design and width of foam casing)

My solution: help distribute the weight over a longer portion of each finger (increase width of handle)

3. To prevent the knuckles of the carrying hand from being pushed inward-against one another. (Length and rigidity of tube, slit and bore of tube-plastic bag handles put pressure on the ends of tube. If the tube were not rigid enough, it would probably bend down at the ends, which would: push the knuckles together, shift the weight to the middle fingers, and distort the hand by causing the palm to flatten out.)

My solution: help distribute the weight over all four fingers and prevent any inward pressure on the knuckles. (Create a rigid handle that is longer than the palm of the hand, and have the loops put pressure on the end of the rigid handle, not on the fingers)

4. To keep the handles of plastic grocery bags together (in the ergonomic handle), so that when the bags are set down, one may retrieve the entire load (more quickly and easily) by picking up only one handle. (Tubular shape-locking mechanism, bore, rigidity and slit of tube)

My solution: Find a way to keep all of the bag handles together-preferably keeping all in one unit.

Slit 46 provides access of a narrow object (such as a plastic grocery bag handle 28) from the outside of tube 30 to the bore 52 on the inside of the tube.

The large bore provides ample storage space (in the tube of the handle) so as to accommodate many plastic bag handles.

The abutment (or narrow gap) of the sides 47 of the slit 46 of the tube 30 provides a locking mechanism to keep all the bag handles together in the ergonomic handle.

5. To hold multiple handles of grocery bags in one grip. (Large bore of tube)

The large bore provides ample storage space to accommodate many plastic bag handles.

6. To help keep the contents in the bags. (Spring, ring or elastic band—elastic band preferred)

After all the bag handles have been put in the bore (of the tube of the handle), slide the spring, ring, or elastic band completely over the ergonomic handle, and down the neck of the bags as far as possible. The spring, ring, and band will all work to restrict the neck of the bags, and prevent the items in the bags from falling out.

My solution: The spring (or ring or elastic band) of my invention will slide all the way down the necks of the bags—to come in contact with even very small items at the bottom. Also, sliding the spring down the necks of the bags does not trap air pockets in the bags (the open area in the center of the spring allows the air in the bag to escape).

If a large Rubber band is used as the "elastic band", one may slide this band up from the bottom of the bags (or down from the top) to hold such items as glass bottles tightly together, so that they can't move back andforth (and hit one another).

For smaller (or horizontal) items, one could use a regular elastic band. By holding the items down at the bottom of the bags, pulling the bag handles taut, and sliding the band down (the necks of the bags—to the top of the items at the bottom), one could remove any air pockets. This (minimizing of the volume ofair in the bags) would cause the sides of the bag to be pressed tightly against the sides of these items, thereby keeping these small items close together, and hence less likely to hit one another.

This method would also allow one to center a food container (such as those used for Chinese fast-food Buffet restaurants) at the exact bottom center of the bag, to help minimizing it from tipping to the side, or the top from popping open. {Just about every time I (or one of the cashiers in these fast-food places) tie(s) the necks of these bags, the container doesn't seem to be centered at the exact bottom of the bag. Try as I might to center it, it just doesn't want to stay horizontal.}

7. To keep keys accessible when carrying loaded bags. (Hole in the tube, connector, clip, key ring)

My solution: find a way to keep my keys easily accessible, as I am carrying the bags to my car or home.

8. To more easily attach and detach the ergonomic handle from a key ring. (Connector, Clip, Tab in Tube)

My solution: Find a thinner means to attach the handle to the key ring, and/or find a means to attach the handle to the key ring more quickly and easily. This second means could be an intermediate means that attaches to the handle and clips on to the key ring. This second means may attach directly to the handle, or may use a "Jumper" ring (first means) to attach it to the handle indirectly.

The purpose of clip 90 is to make attaching a key ring 150 to handle 22 quicker and easier.

The purpose of connector 80 is to make attaching clip 90 to handle 22 easier.

But even if clip 90 is not used, it would still be easier to attach key ring 150 to connector 80 than to attach it to handle 22 directly.

Even if connector 80 is not used, it would still be easier to attach handle 22 to clip 90 than to attach it (handle) to key ring 150 directly.

Just the other night I noticed just how easy it was to detach the ergonomic handle from a key ring. I had 4 bags of groceries in the handle, which was in my left hand. The key ring was attached to the clip on the handle. In my right hand I had another, heavy bag. It took me about 3 seconds to detach my key ring from the handle (so that I could open the trunk of my car). And, I didn't have to put any bags down to do this!

9. To provide various means of transporting the grip, to keep it with you whenever you need it. (Clip, band, connector, key ring, hole)

10. To provide various means for storage, to help keep it visible so you will remember to take it with you when you leave the house or car (key ring, band, clip, connector, hole)

11. To prevent the grip from cutting or otherwise hurting the hand of the user. (Foam, rounded edges, fillets, tubular design)

The ends of the slit are rounded into fillets (rather than cut at an angle—such as in a v-shaped notch) at the ends of the tube so that the ends will be less likely to cut or scratch the hand of the user.

The sides 73 of the slit are rounded so there are no sharp edges to cut the hand (see FIGS. 2-C and 2-E).

12. To prevent the grip from damaging the handles of the grocery bag. (Fillets, rounded edges of slit of tube)

The ends of the slit are rounded into fillets (rather than cut at an angle—such as in a v-shaped notch) at the ends of the tube so that the ends will be less likely to snag fragile plastic bag handles. (If the fragile plastic bag handles snag on a sharp corner, the thin plastic may be easily torn and may cause the bag handle to fail and the contents to spill out of the bags.)

The sides 73 of the slit are rounded so there are no sharp edges to cut the fragile handles of plastic bags (see FIGS. 2-C and 2-E).

13. To accommodate various size hands and fingers with one size grip. [Length of tube, foam, Lack of finger ridges, girth not too large (foam casing optional)]

14. To anchor the bags together at the top—to help prevent the bags from turning over and spilling their contents. (Locking mechanism of tube-circular cross section of tube, rigidity, slit)

15. To anchor the bags together—to minimize lateral movement in a moving vehicle. [The combined mass of filled grocery bags that are anchored together helps to increase inertia, thus minimize lateral movement caused by the change in velocity and/or direction of a moving vehicle. {Separate filled grocery bags have less mass (i.e. weight), and are more prone to slide or roll around in the trunk of a car when it stops, starts, or turns.}] This decreased lateral movement should help to minimize the chance of groceries hitting each other (or the sides of the trunk), and causing breakage or bruising. [*Visualize if you will, a bunch of loaded grocery bags rolling around in the back of a pick-up truck!] This decreased lateral movement should also help to minimize the distraction to the driver caused by the sound of the groceries rattling around in the trunk.

If one must take public transportation, it would be particularly advantageous to prevent loaded grocery bags from sliding along the floor, or turning over and spilling their contents. (Locking mechanism of tube-circular cross section of tube, rigidity, slit)

16. To provide cushioning—which helps to absorb the shock of the load (as the load bounces up and down when one is walking). (Resiliency offoam, more foam on bottom)

17. To provide an adjustable surface—which helps the handle to conform to the specifics of each users' hand. (Resiliency of foam)

18. To provide a comfortable grip. (Tubular shape, girth, foam, tubular/convex shape of foam casing)

19. To provide a durable grip. (Integral locking means, rigid tube, circular design-no angles to focus stress, durable foam, flexible (not brittle) material-i.e. plastic)

By having the edges 73 (offoam casing 60') set back from the opening (slit 46) of the handle, there is less chance that the edges 73 (of foam casing 60) will be damaged by being abraded by the plastic bag handles.

Because the locking means (narrow slit in the tube/circular cross-section) is integral to the shape of the tubular structure, there are no fragile parts to get damaged or break off.

20. To provide a reusable grip. (Integral locking means, durable materials, locking means is temporary, locking means has some flexibility—thin plastic edges of slit)

21. To provide a grip that is small enough to be easily portable. (Length is preferably about the width of a hand, width is preferably about 1½")

22. To provide a grip that is easily attachable to plastic grocery bags and plastic grocery baskets. (Fillets, rounded edges of slit, rigid yet flexible slit, simple locking mechanism-slit in tube)

Gap 72 (of the foam casing) is wider than, and set back from slit 46 (of the tube), so that the edges 73 (of foam casing 60) won't create friction (drag) at the point where the plastic bag handles are inserted (in slit 46).

The top 32 (of the tube 30' near the slit 46') is thin, so that sides 47 (of slit 46') may flex to accommodate materials (such as the metal handles of plastic grocery baskets) that are wider than slit 46'.

These fillets provide a guiding means to direct and ease insertion of the plastic bag handles into the narrow slit.

These fillets allow the plastic bag handles to glide along the edge into the slit when the plastic bag handles are inserted into the ergonomic handle.

23. To provide a grip that is easily detachable from plastic grocery bags. Some of the prior art handles are easy to attach but not as easy to detach. (Fillets, rounded edges, rigid yet flexible slit, simple locking mechanism—slit in tube)

ADDITIONAL OBJECTS AND ADVANTAGES OF MY INVENTION ARE

24. To provide the most cushioning at the bottom, where it is needed the most. (Tubular Shape Offoam, Offset Bore Offoam Casing)

25. To provide storage for the bag restricting means on the handle itself, to keep everything together. [The foam casing has a tubular shape and rounded ends that allow the spring/ring/band to be slid on (and over) it easily. The diameter of the outside of the foam casing is only slightly smaller than (or the same size as) the inside diameter of the spring. If a ring is used, the inner diameter of the ring should be slightly smaller than the outer diameter of the foam casing. The foam casing can be compressed when sliding the ring over it, and then expand back to hold the ring in place. The spring has flat ends that are slid into the ends of the slit of the tube, and the enlarged pea-shaped termini of the spring anchor the ends of the spring in the bore of the tube. The elastic band is just slid over the end of the foam casing to the center. If the band is large enough, it may be wrapped more than 1 time around the center of the foam casing. If the elastic band is larger than the center of the foam casing, but not large enough to wrap around the handle twice, it may be attached to the clip on the end of the handle.]

26. To provide a means to keep a key ring (with keys on it) handy when it is detached from the grip. [The elastic band can be attached to a key ring in the following manner: place one end (first end) of the band through the bore of the key ring, and wrap this end all the way around the side of the ring. Next, insert the first end between the sides of the band of the second end (on the other side of the ring). Next, let go of the second end and grasp the ring securely with that same hand. Then pull the first end tightly (through this opening) and away from the ring with the other hand. As you pull the first end away, the loop of the second end will slide along the band toward the ring at the other end. The resulting loop around the keyring will get smaller as the first end is pulled away, and will form a temporary knot when the first end is pulled taut. This attached band may be applied to other objects either by expanding the band around the other item (such as the handle of a doorknob), or by attaching it to the other item in the same kind of 'loop slipknot' way that the band was attached to the key ring.

There are two similar 'loop-slipknot' methods that use the band to attach a second item to a first item.

The first 'loop-slipknot' way is done exactly like that used to attach the band to a keyring. One would feed the first (free) end of the band through the center (and/or around the sides) of a second object. One would then feed this first (free) end back between the sides of the second end of the band (to which the first item is attached), and pull the free end tightly away from the objects attached at the other end. This method attaches the two items together at one end of the band, and leaves the other end of the band free (such that both items can be hung from items such as a doorknob). This method holds the two items together fairly securely—but can be easily undone simply by gently pulling the two objects apart.

The second 'loop-slipknot' way is almost identical to the first way. One would still feed the first (free) end of the band through the center (and/or around the sides) of the second object. But (instead of passing the first end between the sides of the second end of the band) the first end is expanded and passes completely over the object attached at the other end. The two objects are then pulled apart from one another. In this method, each item is securely attached to opposite ends of the band. The two items may still be easily separated from one another simply by pulling up on one end of the band (to reopen a loop), and pull the second item back through the opening. This process (lifting up on the end of the band near the attached object) can be repeated to open up the other loop so that the first item may be slid off of the band.]

27. To provide a handle whose bottom conforms more readily to the natural curvature (of the middle knuckles) of the hand in a grasping position. (The preferred embodiment has a longitudinally convex foam bottom, which aligns with the natural (longitudinally convex) shape of the middle knuckles of the hand in a gripping position.)

28. To more readily conform to the natural lengthwise curve of the fingers in a grasping position. (Tube,foam)

29. To provide palm support—which encourages the use of the whole hand in gripping, possibly helping to distribute the stress away from the hand, and more toward the forearm and biceps. (The shapes of the tube and foam girth of the handle)

30. To help alleviate stress by working out muscle tension. (Foam is resilient)

31. To provide a grip that actually functions—(not just sounds good in theory). (I made a prototype of the original embodiment on Oct. 31, 2001. I have been using that handle for the past 11 months. I take it almost everywhere I go, and use it every time I shop. It works like it is supposed to.)

[I have read many patents on related handles, and I honestly don't think some of them will work very well, several won't really work at all, and none of them has as many advantages as my handle. The reason why my handle has so many advantages is that I spent a lot of time in the past 2 years working on the design, to make it the best I could. I sincerely think this handle design will make shopping a less painful and tedious experience for people. It has for me.

And . . . anything else I might have missed . . .

The following two functions follow the "rock, paper, scissors" principle.

The tube is circular in cross-section, the tube is (preferably) made of plastic, and the tube is not very thick. These factors allow the edges to flex outward and the slit to increase in width when pressure is applied to insert an item (such as the metal handles of plastic grocery baskets) that is wider and more dense/rigid than the edges of the slit). When the pressure is removed, the circular design causes the edges to snap back to their original location, and the slit to close back up. (the slit of the tube yields to the metal basket handle)

Plastic grocery bag handles are wider, but less dense/rigid than the sides of the slit. When these handles are forced into the slit, they will be compressed by the (more) rigid sides of the slit, allowing them to fit through the opening. Once it is inside the bore, that item will expand back to its original width. Since it is wider than the slit, it will be difficult for it to accidentally come out of the handle at the slit. (The plastic bag handles yield to the slit of the tube.)

Operation

Preferred Embodiment

Part 2

To Use the Handle:

"Thumbnail" Version:

Hold the handle in one (first) hand, and the bag handles in the other (second hand). Use your thumb of first hand to anchor one end of the bag handle at the end of the bore (slit facing up), and with the second hand, pull the bag handles taut and push other side of the bag handle against the slit. You can push or pull the bag handles through the slit and into the bore. It usually makes a snapping sound when the handles enter the bore. The spring or elastic band is then slid completely over the handle and down the neck of the plastic bags—to restrict the neck of the bags and prevent the items in the bags from spilling out.

More Detailed Version:

The elastic band is removed from the Handle. Snapping the plastic bag handles into the Handle is really very simple, and can be done any number of ways. This is just one way. Grasp both handles of a plastic bag in one hand, with your palm down. With the Handle in a vertical position, grasp it with the thumb, index and middle finger of the other hand. This hand should be palm up, and the thumb and middle finger should be at the middle sides of the Handle. One end should be in the center of your palm, and the top side (side with slit) should be facing up. Place this hand underneath the first, on the outer side of the bag. Wrap the ring and pinkie finger of the second hand around the bag handles that are in front of the thumb of the first hand, and pull the tips of these 2 fingers into the palm of that hand. Hold the handles of the plastic bag securely against the palm of the second hand. Bring that thumb towards your palm and slide the handle out towards the tips of the index and middle finger. The end of the Handle should now be at the base of those fingers. This second hand looks like you're making a palm-up "peace" gesture, with the Handle in the "v". Support the Handle with the two outstretched fingers. Pinch the plastic bag handles with the thumb and index finger of the first hand. Move these fingers to the bottom end of the handle, at the base of the cut. Using the thumb of the second hand, press the bag handles into the center of the tube, and hold in place.

Keep the second hand stationary. Slide the middle and ring finger of the first hand out, and place them against the back of the other end for leverage. Start to move the first hand away, pulling the plastic bag handles taut. When your thumb of your first hand is at the other end of the cylinder, rotate this hand towards the back of the handle, palm up. The bag handles should snap through the slit and into the bore of the tube. Repeat this process with each bag.

Slide the elastic band completely over the handle. Slide the elastic band down the neck of the plastic bags towards the base of the bags, until there is a slight resistance. The openings in the plastic bags should be between the Handle and the elastic band if possible. Carry the bags with the handle; just make sure the top side always faces up. If you wish, you can use the clip to attach your keys to the handle.

Description

Original/Alternate Embodiment

{Also see "Description of prototype (original/alternate embodiment)" and "How to make the prototype (original/alternate embodiment)" on pages 17-21.}

Page 5

FIG. 1'-A shows the side view of the assembled parts of the handle. The shaded area indicates the (fabric) cover 100. Solid lines indicate edges of materials, unless otherwise noted. Dashed lines indicate the edges of the parts inside (such as the clip 90' and inner 48' and outer 50' surfaces of tube 30'—as would be seen in section A). Dashed lines are also used to show parts (spring 110) on the backside of the handle—as if all the parts were semi-transparent. The dashed lines of the spring 110 and the clip (metal lanyard hook) 90' are drawn with darker lines, to distinguish them from the inner 48' and outer 50' surfaces of the inner plastic cylinder 30'. For clarity, the top edge 62 of the foam casing 60' is drawn with a solid line (to distinguish it from the top of inner surface 48' of the tube 30'), even though it is behind the cover 100. [In side view, the line for the top edge 62 of the foam casing 60' and the line for the top of inner surface 48' of the tube 30' coincide, which is why that line is indicated by two reference numbers.] The top edge 32 of tube 30' is indicated by the same line as the top edge 102 of the cover 100, as the actual distance between the two is negligible (they are in direct contact at this point). The brackets for the inner plastic tube 30' and intermediate foam casing 60' are used to indicate the height of these materials (from what line to what line they occur) behind the shaded area of the cover 100.

FIG. 1'-B shows the top view of the assembled parts of the handle. The shaded portions show the parts covered by the fabric cover 100. The unshaded portions show the clip 90' and the parts of inside surface 48' of tube 30" that are not covered (such as hole 42). For clarity (I thought too many dashed lines would get confusing), I did not dash the lines of the edges of the top 62 of the foam casing 60', even though they are behind the shaded area of the optional fabric cover 100. Also for clarity, I did not show these solid lines (indicating the top edges 62 of the foam casing 60') in the areas behind the top portion of the spring. I also did not show a dashed line for slit 46 of tube 30' in the areas behind the top portion of the spring 110. The brackets are used for clarification, as in FIG. 1'-A. The brackets for the foam casing are separated into 3 parts. The solid lines indicate where the foam casing 60' occurs on the top portion of the handle, and the dashed line indicates that the foam casing 60' continues all the way around the bottom of the handle. Once again, heavy dashed lines indicate the hidden portions of spring 110. The two sets of double dashed lines that run lengthwise indicate the inner 48' and outer 50' surfaces of the tube 30' (at the widest point as seen from above). These sets of double dashed lines would be seen in a longitudinal section cut B—taken from midpoint 58 of one side 36 of the tube 30' to midpoint 58 of the other side 36 of the tube 30'). The line for the outer surface 50' of tube 30' coincides with line for the inner surface 74' of foam casing 60', as they are in direct contact (the thickness of adhesive considered negligible).

FIG. 1'-C shows the end/section views of the assembled parts of the handle. The (inner) tube 30', the (intermediate) foam casing 60', and optional fabric cover 100 are shown in section (for clarity); the clip (in this case a metal lanyard hook) 90', and outermost spring 110 are shown in end view. The section portion of the view is taken perpendicular to the length of the handle, and goes through the hole 42 on (left) end 38 of tube 30' (see section line C in FIG. 1'-A). The end portion of the view is also taken at the (left) end 38'. Hatching is used for the (intermediate) foam casing 60', to distinguish it from the tube 30' and the optional fabric cover 100. The darkest, thickest line indicates the (fabric) cover 100. There is a gap between the (fabric) cover 100 and the (outermost) spring 110. Dashed lines show the back end of the spring 110 where it is hidden by the front end of the spring 110. Section lines A and B are used for reference in FIG. 1'-A and FIG. 1'-B, respectively.

Page 6

FIG. 2'-A shows the side view of the tube 30'. The dashed lines indicate the inner surface 48' of the tube 30', as would be seen in a longitudinal section cut through the top 32 and bottom 34' of the tube 30' (parallel to section line A in FIG. 1'-C). The hole 42 is inside the main portion of the (left) end 38'. [In the preferred embodiment, hole 42 is located in tab 44 that extends outward from end 38 of tube 30.]

FIG. 2'-B shows the top view of the tube 30'. The dashed lines indicate the inner surface 48' of the tube 30', as would be seen in a longitudinal section cut through the sides 36 of the tube 30' (see section line B in FIG. 1'-C).

Showing these inner 48' surfaces are important in understanding that the bore is relatively large. The distance between the inner 48' and outer 50' surfaces is also important because the material chosen (a plastic). Plastics (as well as other materials) are flexible when they are thin, and rigid when they are thick. The top edge 32 (where slit 46 is-at the opening) should be somewhat flexible (i.e. thin). Conversely, the bottom edge (where all the weight will be focused) should be fairly rigid (i.e. thick). There are fillets 40 at end 38' and end 39' on each side 47 of slit 46. This figure shows that the sides 47 of slit 46 abut one another (but there may also be a slight gap between sides 47 of slit 46).

FIG. 2'-C shows the end view of the tube 30'. This view is taken from (left) end 38'. The dashed lines indicate the location and width of the hole 42. Note that the sides 47 of slit 46 are rounded. In this view there is a very slight gap between sides 47 of slit 46. The material of tube 30' is thicker at bottom 34' than at top 32. [The longitudinal axis 54 of bore 52 is slightly eccentric (off-center) vertically to the longitudinal axis 56 of outer (circumference) surface 50 of tube 30'.]

FIG. 4'-A shows the side view of the clip (modified Metal Lanyard Hook) 90. The dashed lines indicate the original shape of the Metal Lanyard Hook. The clip 90 was flattened (bent outward) at the neck of the clip to make it easier to attach to the hole. [I had forgotten to add clip 90 to tube 30' before I attached the foam casing, and it was hard to attach clip 90 in its' original shape.] Clip 90' is attached to hole 42 of tube 30' with narrow (right) end 99 extending through hole 42, wide (left) end 98 extending away from the handle to the left, and opening 95 pointing down. [The opening 95 of clip 90' could also be oriented at the top of the clip.]

FIG. 4'-B shows the top view of the clip (modified Metal Lanyard Hook) 90'. This view shows the width and length of clip 90' (approximately to scale).

Page 7

FIG. 5'-A shows a side view of the (intermediate) foam casing 60. I also show clip 90' (modified metal lanyard hook) at the left, because there is a notch 70 (cut into end 68' of foam casing 60') to help accommodate clip 90'. The set of dashed lines shows the top and bottom of inner surface 74' (of foam casing 60'), as would be seen in a vertical longitudinal section cut [taken from top to bottom, parallel to section line A (see FIG. 5'-C)]. The dashed lines are shown to indicate that the foam material is thinner at top 62' than at bottom 64'. The dashed lines are also used to show the location of tube 30' within foam casing 60'. [Inner surface 74 (of foam casing 60') corresponds with the outer surface of tube 30'.] The foam casing 60' is rounded at ends 68 and 69, where it joins with ends 38&39 of tubular structure 30'. The foam is rounded all the way around bore 75 at each end. This rounding (of the foam casing 60') starts about ½" in from each end, and stops at ends 68' and 69 (of the foam casing 60').

FIG. 5'-B shows the top view of the (intermediate) foam casing 60'. The set of long horizontal dashed lines indicate the inner surface 74' of the foam casing 60' at the widest point of the bore (when seen from the top 62). This inner surface 74' would be seen in a horizontal longitudinal section cut. [Horizontal section cut B would extend through midpoint 77 on one side of bore 75 (of the foam casing 60'), and through midpoint 77 on the other side of bore 75 (See FIG. 5'-C).] The short dashed lines at the (left) end 68' indicate notch 70 in foam casing 60'.

There is a gap 72 at the top 62 of the foam casing 60'. Gap 72 is wider than slit 46 of the (inner) tubular structure 30' (see FIG. 1'-B). The center of gap 72 is aligned with the center of slit 46. Each side 73 of gap 72 is the same distance (about ⅛") from slit 46 (of the inner tubular structure 30').

There are fillets 78 (in the foam casing 60') at end 68' and end 69' on each side 73 of gap 72. [These fillets 78 are similar to the fillets 40 in tube 30'.]

FIG. 5'-C shows the end view of the (intermediate) foam casing 60'. This view illustrates how the thickness [distance between inner surface 74 and outer surface 76] (of foam casing 60') varies around the sides 66 from top 62 to bottom 64. The short dashed lines at the bottom of bore 75 indicate notch 70 (in foam casing 60') for the placement of the clip 90'. Section lines A and B are used for reference in FIG. 5'-A and FIG. 5'-B, respectively.

Page 8

FIG. 7-A shows the side view of the optional outside cover (fabric) 100. My prototype has a fabric cover 100, and I tried to illustrate this as well as I could. The dark dashed lines indicate where cover 100 wraps around the inside 48' of tube 30'. The dotted lines indicate the bottom 64 portions of the inner 48' and outer 49' surfaces of tube 30'. These surfaces are shown to locate where hole 42 of tube 30' is located-relative to ends 108 of cover 100. I also show clip 90' to help indicate that (fabric) cover 100 does not cover hole 42 in tube 30'.The portion of clip 90' that is hidden behind cover 100 is shown with light dashed lines.

FIG. 7-B shows the top view of the optional outside cover (fabric) 100. The dashed lines indicate where cover 100 wraps around inside 48 of tube 30'. I also show clip 90' and hole 42 (of tube 30') for illustrative purposes. The dotted lines represent the (sides 36 of) inner surface 48' of tube 30'. This view shows a small gap 101 between the top 102 edges of the fabric cover (as they wrap around edges 47 of slit 46 of tube 30).

Page 9

FIG. 8-A shows the side view of spring 110. The dashed lines indicate the backside of spring 110. The shaded areas show outer surface 122, and the non-shaded areas show inner surface 120 of spring 110. The ends 118 of spring 110 have "pea-shaped" termini (ends) 124.

FIG. 8-B shows the top view of spring 110. The dashed lines indicate the bottom part of spring 110. The shaded areas show outer surface 122, and the non-shaded areas show inner surface 120 of spring 110. The ends 118 of spring 110 have "pea-shaped" termini (ends) 124.

FIG. 8-C shows the end view of spring 110. The dashed lines indicate the back part of spring 110 (which is hidden behind the front part of spring 110 in the end view). The ends 118 of spring 110 have "pea-shaped" termini (ends) 124. The portions of the ends 118 (of spring 110)—just before termini 124—curve in towards to the center.

Page 10

FIG. 10A shows the top view of modified tubular structure (30) with necklace (160) attached to hole (42) in tab (44). Necklace (160) provides another way to keep the handle visible and easily accessible, such as by using the necklace to hang the handle from a doorknob.

Page 11

FIG. 11A shows the front view of key ring 150 with a set of keys and band 140 attached using the "loop-slipknot" method of pages 27-28. This figure shows one way that a person can store their keys in a very visible and easily accessible location—such as the inside door knob at ones home—no more lost keys!

FIG. 11-B shows the top view of the handle with key ring 150 and band 140 attached using the loop-slipknot method mentioned above. Clip 90 helps the handle to be quickly and easily attached to other objects, such as the key ring assembly of FIG. 11-A. The various connecting elements (band, ring, clip, connector, and hole in handle) allow the handle to be stored in many convenient locations, so a person will remember to take it with them when they go shopping.

DESCRIPTION OF PROTOTYPE OF ORIGINAL/ALTERNATE EMBODIMENT

I have made (on Oct. 31, 2001) a working model of my invention. I will use approximate dimensions taken from my model. I know these will work, based on trying out the invention in my home. I may want to (and will probably have to in the manufacturing process) modify these approximate sizes (and possibly materials) later, based on actual testing in public and results over time.

Modified Tubular Structure

There is an inner core of a modified tubular structure. It is made of "Friendly Plastic"—which becomes pliable when submersed in warm water. It is about 3¾" long, and appears to be about 13/16" wide/tall. It has an inner diameter of ⅝". The plastic varies from about 1/16" at the cut side for flexibility, to about ⅛" on the bottom side-for reinforcement. (I may want to adjust the thickness (or type) of plastic, as well as the length or diameter of the tube later.) This tube is cut all the way through down the length of one side. This side forms the top. This cut edge and the two cut ends are rounded with a radius of approximately ½ the width of the material. The top (cut) side is where the handle of the bags is inserted. The bottom side is thicker, as it provides resistance against stress and gravity. Each end of the tube is open (to the bore in the center of the tube).

The cut in the top flares out towards each end. This flaring out is accomplished by providing each end of the tube (at the top) with 2 fillets (rounded edges). Each fillet starts at the vertical midpoint of each side of each end. The two fillets meet at the cut at each end of the tube. Each fillet is formed with about a ½" radius. The fillets curve in the X, Y, and Z plane, to follow the inward curvature of the tube.

Metal Lanyard Hook

There is a hole at the bottom side of the plastic core at one end. It is centered about ¼" in from the end and is about 1/16" in diameter. I have a 23-MM metal lanyard hook inserted into this hole to attach to my key ring. [I may increase the size of the hook or replace it with a similar device like a key ring, key chain ring or Lobster Claw hook. I may also want to move the hole closer to the edge, increase or decrease the diameter of the hole, and possibly add a metal grommet or other reinforcement. I may just thicken the plastic along this edge. These might be improvements, but it works fine as it is.]

Foam Casing

A foam casing surrounds the inner plastic core. I used Crayola "Model Magic" modeling compound. The foam casing runs the length of the cylinder, and most of the circumference. The outer diameter of the foam casing is about 1½". The inner diameter of the casing is the outside diameter of the plastic core. The foam is flush up against the plastic core the entire length. The thickness of the foam varies from 0" at the very top edge of the cylinder, to about ½" at the bottom. The bottom needs to have the most cushioning-where the weight will be. [I may want to increase or decrease the thickness of, or change the type of foam later.] The foam tapers gradually around the circumference of the cylinder from the bottom to the top. It stops at about ⅛" from the cut edge on both sides of the cut. At this point it is about 1/16" to 1/32" thick. The bag handles will slide through the cut in the plastic cylinder at the top, and the foam can not go all the way to the edge, or the edges of the foam may crumble.

Optional Covering

The foam casing is fine as the outside element, but I may want to use a covering, to help prevent the foam from crumbling, or to protect the surface. A fabric covering might give a more finished appearance to the Handle. I used a fabric cover on my model. The fabric covering on my model wraps around the outside of the foam casing and the inside of the plastic cylinder. I may want to wrap the fabric around the foam casing only, and then insert the plastic cylinder. This might prevent the edges of the fabric from coming loose. This method might also give an even more finished appearance to the handle, as no edges of the fabric would show. I will have to experiment with the manufacturing process and see if this would be a viable alternative.

Any suitable fabric could be used, based on customer preferences. The handle could also be covered in latex, rubber, thin plastic, or other suitable coating (that does not interfere with the cushioning properties of the foam). It could also be painted. Whatever coating used, it should not interfere with the sliding of the bags through the cut at the top. [The gap in the cut could be increased to accommodate a surface material, if the surface material went around the cut surface.] Crayola "Model Magic" comes in different colors. Picking a color of this material (other than white) would probably increase the aesthetics of the Handle, and a coating may not be necessary. The manufacturing process would probably give a more uniform appearance to the foam casing. My model is hand made, so it looks better with a cover.

Spring

The last element in the invention is a spring. It slides over the foam casing of the Handle. It may be made of plastic or metal, or other suitable material. It should attach to (and easily detach from) the handle in some way, to keep all the elements together.

I am not sure at this time what will be the exact best configuration of the spring, or exactly how it should attach to the handle at this time. I have made a spring that will work, but it is difficult to achieve the results I want with the materials I have. Better manufacturing methods may yield better solutions. This spring is the best solution I have at this time. The spring I made is of "Friendly Plastic". When detached from the Handle, it is about 3¼" long, with 1⅝" inside diameter. The coils are flattened on the outside and inside, rather than perfectly round. (When the spring is viewed from the top, the coils are wider. When the spring is viewed from the end, the coils are thinner. This design made construction of the coil easier for me, because the strips of plastic were flat. The thickness (viewed from the end) of the plastic coils varies from 1/16" to ⅛". The width (viewed from the top) of the plastic coils varies from ⅛" to ¼". [This variation was due to the difficulty in working with the plastic, and was not intentional.] Each end of the spring has a rounded tip. This tip is about the size and shape of a pea. The end of the coil just before the rounded tip is curved inward slightly.

The rounded tip is for safety (if the spring is to be made of metal), for a finished look, and to anchor the spring to the handle. The rounded tips may not be functionally necessary, as the pressure holding the cut closed should be enough to hold the ends of the spring in place.

The spring should wind around the handle at least (if not more than) 2 times. The spring should be shorter than the length of the cylinder, (perhaps ¾ of the length). It should lengthen enough (perhaps by ¼) to allow placement of the ends in the filleted notch or cut on both ends. It should be able to compress an approximately similar amount, to help keep the ends snug in the notches.

How to Make the Prototype (Original/Alternate Embodiment):

Modified Tubular Structure

I used 3 pieces of "Friendly Plastic" to make the plastic cylinder. The strips are approximately 1½" wide, by 2½" long. I put hot (about 150 Degrees. F.) water in a bowl. I then submersed a piece of the plastic in the bowl and let it soften a bit. I took it out, and filleted 1 corner, using scissors. I cut the corner by eye, approximating a radius slightly smaller than the width of the strip (½"). I reheated this piece to soften it more, then placed it on a 1⅝" diameter wooden dowel. The length of the strip was parallel with the length of the dowel, and the long side with the fillet was at the top. I wrapped the piece around the dowel, to curve the piece. The piece went about ¾ of the way around the circumference of the dowel. Since I would be using 2 pieces of plastic to make the cylinder, it only needed to be maybe ⅝ of the circumference, so I trimmed off about ¼" of the (bottom) long straight side, to make the strip 1¼" wide. (By trimming the same amount off the long end of the second piece, I would have an overlap of about ½". The dowel has a circumference of 2" and the combined width of the two pieces would be 2½". I figured this overlap should be sufficient to join the two pieces together.) I then used a knife to serrate this bottom straight side (that still had corners at each end). The serrations were about ¼" long, spaced about ⅛" apart, and ran parallel to the short ends.

I softened a second piece of plastic, and filleted the one of the corners as I did with the first piece. I put it on the opposite side of the dowel, the filleted length of the second piece facing the filleted length of the first piece. (The two filleted edged were facing another.) These long edges were placed to butt up against each other. Once this edge was smoothed down to the dowel, I pressed the plastic around the dowel opposite the direction of the first piece. I overlapped the plastic at the bottom. (The two non-filleted lengths overlapped by about ½). I pressed similar serrations on the outer portion of the bottom edge of the second piece, and pressed the pieces together. By pressing parts of one piece into the surface of the other piece, I hoped to create a better bond or connection.

Whenever the pieces of plastic started losing their pliability, I would soak them in a pitcher of hot water, and then resume the molding process.

Now would be a good time to use an awl (or similar pointed instrument) to punch the clip hole in the bottom of one end. This should be done while the plastic is soft, before setting it. After submersing the plastic in cold water to harden/set it, the clip could be attached. (I forgot to punch the hole before I set the plastic. I had to drill the hole later, using the tip of a knife, and rotating it back and forth.)

Now I had the basic shape I needed but it was not long enough. The piece needed to be at least the width of my palm. I did not need another 2½" length, so I decided to attach the length of the 3rd strip perpendicular to the lengths of the previous two strips. I softened these existing pieces of the cylinder, and made serrations in the unfilleted end of the cylinder. Then I softened the third strip of plastic, and gently wrapped it around the dowel, away from the other 2 pieces. I did not want to attach it at this point. I then trimmed the excess material (about ½") off one end. (The circumference of the dowel is about 2" and the length of the piece was about 2½'. I needed the plastic to go all the way around the circumference, and the short ends to butt up against one another.) I then removed the plastic from the dowel, and filleted the top and bottom right corners, holding the strip vertical. I then softened the plastic again, and wrapped it around the dowel. I overlapped the non-filleted long edge of the third piece over the non-filleted end of the existing cylinder (the fillets on this end were also facing one another.) Once again, I pressed serrations into the overlapping portion, and pressed the two edges together. I soaked the cylinder in cold water to set the plastic.

Metal Lanyard Clip

The lanyard clip should be attached to the hole at this time. The bottom end (the end with the smaller radius curve) may need to be stretched out to attach the clip to the hole.

Foam Casing

I used Crayola "Model Magic" for the foam casing. I made a sphere out of the foam. Then I pressed the bottom of the cylinder in the foam, and gradually smoothed the foam towards the sides. The foam is about ½" at the bottom, and tapers to a minimum of about 1/16" just short of the cut edge. On the ends, the foam is slightly rounded, rather than gradually tapered. The foam should be fairly thick at the bottom ends (for cushioning), but have no corners. At the fillets at each end, the thickness of the foam gradually increases from the minimum at the cut side, to the thickness at the bottom ends. The foam should be smoothed so there are no ridges, lines, or abrupt changes in thickness.

Optional Coating

The coating is optional. I took a small piece of fabric and coated it with "FrayBlock" to try to give it a waterproof coating (I heard they no longer make "Scotch-Guard"). I let that dry. Then I coated the entire underside of the fabric with a fabric glue (Aleene's "OK To Wash-It" fabric glue). I let the glue dry a little. I wrapped the fabric around the foam casing, and tucked the ends into the cut side at the top. I smoothed the fabric around the cut, and to the inside of the plastic cylinder. Then I tucked the other ends into the center of the cylinder at the ends. I pressed the fabric down against the foam and plastic to help it bond.

Spring

The spring is made of "Friendly Plastic". I cut about 8 strips about 3/16" thick, and 2½" long. These strips were cut own the length of the piece of plastic. I used 2 pieces. I softened each strip in hot water, then used needle-nose pliers to press slight grooves into each end. I wrapped each strip around a plastic tube that had an outer diameter of 1⅝". (Since the tube was also plastic, I covered the tube with cooking oil, so the "Friendly Plastic" would not stick to the tube.) One side of the end of the first strip was tangent to the end of the tube. I wrapped the strip in a slight spiral around the tube; with the inner edge of the other end of the strip about ½" from the end of the tube. I warmed another strip. I laid the first end of this strip over the second end of the first strip, and overlapped the ends for a ¼" inch lap. To help join the ends together, I pressed the back of a warmed spoon to the top of the join. I pressed a warmed knife to the sides of the join to keep a straight edge. I kept adding strips in a similar fashion: pressing grooves into each end, over lapping by ¼", and maintaining a ¼" gap between each strip. The spring has 6 revolutions.

I took short pieces of one of the remaining strips of plastic to make the ends. I warmed each piece, then folded it in half. I overlapped the ends of the short piece over each side of the end of the spring. I pressed this lap together to join the pieces, and to make it the same thickness as the spring. I took the plastic at the very end and pushed it back to mold the pea shaped tip. I then put the spring in cold water to set the plastic.

Operation

Of Original/Alternate Embodiment

The original/alternate embodiment functions almost exactly like the preferred embodiment, except that the elastic band in the preferred embodiment is replaced with a spring in the original/alternate embodiment. Both the elastic band and the spring are used as bag-neck restricting means, and both are stored on the handle. When the spring is used, it is easier to slide the spring over the handle when the handle is first turned 90 degrees to the vertical. The following section is a copy of the operation of the preferred embodiment, with the added operations for the spring listed in Italics.

To use the handle: The spring is removed from the Handle. Snapping the plastic bag handles into the Handle is really very simple, and can be done any number of ways. This is just one way. Grasp both handles of a plastic bag in one hand, with your palm down. With the Handle in a vertical position, grasp it with the thumb, index and middle finger of the other hand. This hand should be palm up, and the thumb and middle finger should be at the middle sides of the Handle. One end should be in the center of your palm, and the top (cut) side should be facing up. Place this hand underneath the first, on the outer side of the bag. Wrap the ring and pinkie finger of the second hand around the bag handles that are in front of the thumb of the first hand, and pull the tips of these 2 fingers into the palm of that hand. Hold the handles of the plastic bag securely against the palm of the second hand. Bring that thumb towards your palm and slide the handle out towards the tips of the index and middle finger. The end of the Handle should now be at the base of those fingers. This second hand looks like you're making a palm-up "peace" gesture, with the Handle in the "V". Support the Handle with the two outstretched fingers. Pinch the plastic bag handles with the thumb and index finger of the first hand. Move these fingers to the bottom end of the handle, at the base of the cut. Using the thumb of the second hand, press the bag handles into the center of the plastic cylinder, and hold in place. Keep the second hand stationary. Slide the middle and ring finger of the first hand out, and place them against the back of the other end for leverage. Start to move the first hand away, pulling the plastic bag handles taut. When your thumb of your first hand is at the other end of the cylinder, rotate this hand towards the back of the handle, palm up. The bag handles should snap into the center of the plastic cylinder. Repeat this process with each bag.

Now take the handle and rotate it 90 degrees to the vertical Make sure the exposed plastic bag handles wrap around the back/bottom part of the Handle. Place the spring in one hand, and the Handle in the other. Press the spring down over the Handle as the other hand pushes the handle up through the spring. Slide the spring completely over the handle. Slide the spring down the neck of the plastic bags towards the base of the bags, until there is a slight resistance. The openings in the plastic bags should be between the Handle and the spring if possible. Now rotate the Handle 90 degrees back to the horizontal position, making sure to keep the cut side up.

Carry the bags with the handle, just make sure the cut side always faces up. If you wish, you can use the clip to attach your keys to the handle If the bags are full, the spring would compress. (Overfilling the bags may press the spring up against the fingers of the hand holding the Handle, possibly causing discomfort. A simple solution to this is to either: use more bags and not fill them as full, or simply not use the spring.) If the bags are not very full, the spring would extend The spring could be slid down the neck of the bags, to come in contact with the items within. In this position it would hold them at the bottom of the bags. This would make it even less likely that items would fall out of the bags.

To Store the Spring on the Handle—

The spring is slid over the Handle. A pea-shaped termini (or "pea-tip") is inserted into the center of the cylinder at one end. The flat portion of the coil just above it is slid through the top, just inside the cut edge. The other tip is then slid similarly into the cut in the opposite end. Since I am not an engineer, I couldn't get the length of the spring perfect. I have to twist the spring around the Handle to get the second tip in the cut. I plan on adjusting the length, so no twisting will be required.

CONCLUSION, RAMIFICATIONS, AND SCOPE

Accordingly, the reader will see that the ergonomic handle of this invention does indeed provide a comfortable handle to carry groceries, as well as a way to hold all of the plastic bag handles together in one compact unit.

In addition, this ergonomic handle solves many of the problems (in carrying loaded grocery bags and baskets) that existed previously.

Furthermore, this ergonomic handle provides other advantages such as those listed at the beginning of this specification.

Although the description above contains many specificities, these should not be construed as limiting the scope of the invention but as merely providing illustrations of some of the presently preferred embodiments of this invention.

For Example:

The Ergonomic Handle:

The handle may include a standard metal key ring (a.k.a. a "split ring").

The handle could include an additional locking means.

The handle may include a magnet in some portion thereof.

The Tube:

The tube could use any of a number of alternate "guiding means" to facilitate the placement of the plastic bag handles through the slit and into the bore.

The tube could be made of various materials, such as any kind of flexible or rigid material like plastic, metal, wood, or a composite of materials.

The tube 30 could alternately be stamped out of a sheet of material, and then formed around a cylinder (to give it a tubular shape). The features: protrusion 44, hole 42, fillets 40, and rounded edges 49 (of the inner 48 and outer 50 surfaces) could be part of the stamp, or machined later (before or after forming around the cylinder). If the sheet of material is of a consistent thickness, portions (such as at the top edges) of the stamped-form could be altered (such as by sanding) to make the material thinner. The stamped form could also have additional pieces laminated to certain parts for reinforcement (such as to thicken the bottom of the tube)

The modified tubular structure 30 could also be made from a prefabricated tube that is cut to the desired length. The features: protrusion 44, hole 42, slit 46, fillets 40, and rounded edges 49 would be machined from the prefab tube.

The tube could have a convex bottom on the outside. The material of the tube (at any point) could be anywhere between 1/64" and 3/4" thick. The tube-could be anywhere between 2" and 6" long. The inner diameter of the tube could be anywhere between 1/8" and 3" across. The outer diameter of the tube could be anywhere between 5/32" and 4½".

The tube could have non-rounded edges for the ends and/or slit. The tube could have bevels (rather than fillets) on each side of (one or both ends-of) the slit. The tube could have fillets at one end only, on each side of the slit.

The tube could have one fillet only, on one end. The tube could have two fillets only, one on each end.

The Foam Casing:

The foam casing could be (at any point) anywhere between 1/16" and 2" thick. The foam casing could be anywhere between 2" and 6" long. The foam casing could have an inner anywhere diameter between 5/32" and 4½". The foam casing could have an outer diameter anywhere between 9/32" and 8½".

Other possibilities for the foam material could be similar (or identical) to the foam used by Plaid Enterprises, Inc. (of Norcross, Ga.) to make their Stamp Decor (TM) foam stamps. Another possible foam material could be similar (or identical) to the foam used by © Rubber Stampede, Inc. (of Whittier, CA.) to make their foam stamps.

The foam casing could be made of a foam (or foams) of different densities. The outer part of the casing could be of a higher density than the inner part. This would probably make the outer portion more durable, but still provide sufficient cushioning. These layers could be poured successively in the casting process—each layer poured before the previous layer cures to bond them together. The layers could also be cast separately, then attached together with. adhesive or heat bonding.

The foam casing 60 could be stamped (or otherwise cut) out of a sheet of foam material, and then formed around a cylinder or adhered to the tube 30 to give it a tubular shape.

Alternate forms/materials: The foam casing 60 could also be replaced by a rubber casing with longitudinal or circular fins or ridges for shock absorption.

The foam casing 60 could be replaced by a thick silicone rubber casing. An outer casing and inner filler material could replace the foam casing. The outer casing may be made of a flexible outer shell of silicone or rubber and would be attached to the tube all around the perimeter (of the outer surface of the tube). The casing would not cover the protrusion/tab or hole, or come too close to (interfere with the functioning of) the slit at the top of the tube. The space between the tube and the outer casing would be filled with another material, such as a gel. Other filling material could be beads, sand, or other small, rounded material. Whatever the filling material chosen, it should be able to shift location with applied pressure to other areas in the casing where no pressure is applied. The filling material should also be able to move back to its' original location when the pressure is removed.

The Connector:

The connector could be of any size from 1/16" to 6", and made of any material. The connector could be eliminated, and the clip would attach directly to the tube. The connector could be any means to attach the tube to a key, key ring (Split Ring) or clip.

The Clip:

The clip could be of any size from 1/16" to 6", and of any material. The "clip" could be a: "Spring Ring", "Safety Pin", "Sisterhook", "Ball Chain", "Torpedo Clasp", "Fancy Hook & Eye Clasp", "Etch Barrel clasp (2 Loop)", "Swivel Snap-Hook", "Lever Back/Split Loop", "Lobster Claw", or "T-Bar & Circle Clasp", made by such companies as Western Trimming Corporation (of Chatsworth, Calif.), et al.

The "clip" could be the "Clasp" (under the brand name "Better Beads") made by Hirschberg Schultz & Co., Inc.

The Spring:

The spring could be made of any material, have flat ends, and/or be designed so that the coils are circular in cross-section-not flattened The Ring:

The ring could be made of any rigid or flexible material. The ring could be between 1/32" to 1" thick, (viewed looking at the hole).

The ring could be between 1/32" and 6" wide, viewed looking at the end (perpendicular to the hole). The ring could have an inner diameter between 9/32" and 8½. The ring could have an outer diameter between 11/32' and 10½".

The Band:

The band could be of any size, from ¼" to 8" long. The band may be of any thickness, from 1/32" to 1". The band could be a rubber band. The band could be any kind of hair band—such as used to make a ponytail, or hold the end of a braid.

I claim:

1. An ergonomic handle that may be used to carry filled plastic shopping bags and grocery baskets more comfortably and may be stored conveniently, comprising:

an elongated, substantially tubular structure (30), of a material and construction such that said tubular structure is substantially rigid, said tubular structure having an internal longitudinal bore, open from end to end, said tubular structure having a longitudinal handle-admission slit, along top (32), from end to end, said tubular structure not having any ridges and recesses on outer surface (50) that align in a straight line; and at least one multipurpose primary connector, said connector comprising a permanently closed loop elastic band; said band having a substantially circular or oval shape in its original, relaxed state; said band being any size between ¼" and 8" long; said band being made of, or including rubber or a similar rubber-like material, or having a rubber-band like construction; such that said band is able to be easily manually expanded to increase its circumference a significant amount, and such that when this manual pressure is released, said band will automatically contract to substantially regain its prior size and shape; the inherent resiliency of the materials and/or construction allowing said band to be so expanded and contracted numerous times; said resiliency allowing said band to be stored on said tubular structure very compactly, by being expanded around and contracting to fit snugly around said material of said tubular structure; said band being easy to attach to said handle and/or other objects for storage; said band being easy to detach from said handle and/or other objects; and whereby said elastic band can provide all of the following possible uses, though not necessarily simultaneously:

to help the handle from rotating on the bag loops, to keep the handle in its proper orientation;

to align all the bag loops to form a single opening, this single opening making it quicker and easier to pick up the handle;

to temporarily close the necks of the bags, to prevent items from coming out of the bags unintentionally, as might occur if the bags tip over;

to reduce air pockets in the bags, which will help prevent items within the bags from moving around in the bags, which should reduce breakage or damage of fragile items;

to provide a quick and easy way to attach the handle to and detach the handle from a key ring or various other objects, for more versatility in carrying and storing the handle;

to provide a quick and easy way to attach a key ring to and detach a key ring from a variety of other objects—for ease of carrying one's keys, for more secure storage of one's keys, and to make it easier to locate one's keys.

2. The ergonomic handle of claim 1, further comprising at least one secondary connector, said secondary connectors comprising one of: a small ring, a clip, a keyring, a chain key-ring, or similar elements.

3. The ergonomic handle of claim 1, further including a hole near one edge of said tubular structure.

4. The ergonomic handle of claim 1, further including a casing.

5. The ergonomic handle of claim 1, wherein said material of said tubular structure is rounded and/or beveled at, and/or tapered towards one or more edges, such that said material varies in thickness and does not have only 90-degree corners at said edges.

6. The ergonomic handle of claim 1, wherein said slit in said tubular structure is less than ¼" wide at the narrowest portion.

7. The ergonomic handle of claim 1, wherein said tubular structure has one or more beveled and/or rounded corners at one or both ends of said slit, forming notches, such that said slit is wider at one or both said ends than at some portion between said ends.

8. The ergonomic handle of claim 1, wherein said slit in said tubular structure varies in width; and, at the narrowest portion of said slit, sides (47) of said slit are in direct contact with one another.

9. The ergonomic handle of claim 1, wherein said material of said tubular structure tapers, or otherwise decreases in thickness, from bottom (34) to top (32).

10. The ergonomic handle of claim 1, wherein said material of said tubular structure tapers, or otherwise decreases in thickness, from a predetermined portion between said ends towards each said end, such that some portion of said tubular structure has a longitudinally convex outer surface.

11. The ergonomic handle of claim 1, further including at least one quick-release secondary connector, these connectors comprising: clips, chain key rings, or similar elements.

12. The ergonomic handle of claim 1, wherein said closed loop elastic band comprises a hair band, the construction of said hair band increasing the durability and versatility of the band, and by extension, of the overall handle as well.

13. An ergonomic handle that may be used to carry filled plastic shopping bags and/or grocery baskets more comfortably comprising:

a handle member, and at least one multipurpose primary connector, said connector comprising a permanently closed loop elastic band which is not permanently attached to said handle; said band having a circular or oval shape in its original, relaxed state; said band having an inner circumference in said relaxed state that is not larger than the perimeter of the thickest lengthwise cross-section of said handle; said band being made of, or including rubber or a similar rubber-like material or having a rubber-band like construction; said band being able to be stored on said handle very compactly, by fitting snugly around the width or length of said handle; said band being easy to attach to said handle and/or other objects for storage; said band being easy to detach from said handle and/or other objects; and whereby said elastic band can provide all of the following possible uses:

to help the handle from rotating on the bag loops, to keep the handle in its proper orientation;

to align all the bag loops to form a single opening, this single opening making it quicker and easier to pick up the handle;

to temporarily close the necks of the bags, to prevent items from coming out of the bags unintentionally, such as might occur if the bags tip over;

to reduce air pockets in the bags, which will help prevent items within the bags from moving around in the bags, which should reduce breakage or damage of fragile items;

to provide a quick and easy way to attach the handle to and detach the handle from a key ring or various other objects, for more versatility in carrying and storing the handle;

to provide a quick and easy way to attach a key ring to and detach a key ring from a variety of other objects—for ease of carrying one's keys, for more secure storage of one's keys, and to make it easier to locate one's keys.

14. An ergonomic handle that may be used to carry filled plastic shopping bags and grocery baskets more comfortably and may be stored conveniently, comprising:

an elongated, substantially tubular structure (30), of a material and construction such that said tubular structure is substantially rigid; said tubular structure having an internal longitudinal bore (52), that is open from end to end; said tubular structure having a longitudinal handle-admission slit along top (32) from end to end, said slit extending from inner surface (48) to outer surface (50) from end to end; said tubular structure not having any ridges and recesses on said outer surface that align in a straight line; and said handle including a means to attach said handle to other objects, said means being part of said tubular structure, and a connector, comprising a necklace or other similar flexible, shape-shifting items which have loose ends that can be quickly, easily, and repeatedly fastened and unfastened to form a loop or band, whereby the easily connectable loose ends, sufficient length, flexibility, & adjustability of these connectors are particularly well suited to:

make these connectors quick and easy to attach to and detach from the handle, make these connectors quick and easy to attach to and detach from other objects, provide various ways to attach the handle to other objects, for more versatility in carrying and storing the handle;

enable the handle to be attached to a variety of objects, not just to a small key ring, to keep said handle more visible and easily accessible; and to provide a way to quickly and easily attach a key ring to various other objects for ease of transportation, more secure storage, and greater visibility of one's keys.

15. The ergonomic handle of claim 14, further including a hole near one edge of said tubular structure, and at least one element from the group of quick-release secondary connectors: clip (90), chain key ring, or similar elements, which can be attached to and detached from said hole of said tubular structure;

said quick-release connectors not needing to be wound all the way around the slit in a key ring to be attached to same, so that they may be more quickly and easily attached to and detached from said key ring;

said quick-release connectors also allowing said handle to be attached to said key ring without having to pass the material surrounding said hole in said handle all the way around said slit in said key ring, so that said handle may be more quickly and easily attached to and detached from said key ring;

whereby said quick-release connectors allow said handle to be attached to and detached from said key ring more quickly and easily, and whereby said quick-release connectors will also allow said handle to be easily attached to and detached from various objects, for greater visibility and accessibility of said handle, and whereby said quick-release connectors will allow said key ring to be easily attached to and detached from various other objects, for transportation and storage of one's keys.

16. The ergonomic handle of claim 14, further including at least one multipurpose connector, said multipurpose connector comprising some type of elastic band.

17. The ergonomic handle of claim 14, further including at least one element from the group of ring-shaped secondary connectors, comprising: a jump ring (80), a small split ring (80'), a key ring (150), or similar substantially rigid, ring-shaped elements.

18. The ergonomic handle of claim 14, further including an outer casing.

19. The ergonomic handle of claim 14, wherein said material of said tubular structure is rounded and/or beveled at, and/or tapers towards any edge, so that the material varies in thickness, and does not have only 90 degree corners.

20. The ergonomic handle of claim 14, wherein slit (46) in said tubular structure varies in width, and, at the narrowest portion of said slit, sides (47) of said slit are in direct contact with one another.

21. The ergonomic handle of claim 14, wherein said handle has one or more beveled and/or rounded corners at one or both ends of said slit, forming notches, such that said slit is wider at one or both said ends than at some portion between said ends.

22. The ergonomic handle of claim 14, wherein all perimeter edges of said material of said tubular structure are rounded from outer surface (50) to inner surface (48), including said edges at said ends, at sides (47) of said slit, and at any notches or corners.

23. The ergonomic handle of claim 14, wherein said material of said tubular structure tapers, or otherwise decreases in thickness, from bottom (34) to top (32).

24. The ergonomic handle of claim 14, wherein said material of said tubular structure tapers, or otherwise decreases in thickness, from a predetermined portion between said ends towards each said end, such that some portion of said tubular structure has a longitudinally convex outer surface.

25. An ergonomic handle that may be used to carry plastic grocery bags and plastic grocery baskets more comfortably, said handle comprising:

an elongated, substantially tubular structure (30) of a substantially rigid material, with a substantially cylindrical longitudinal bore (52) that is intermediate a top (32) and a bottom (34) and is open at each end (38,39), and a longitudinal admission slit (46) along said top of the tubular structure, said slit being less than ¼ inches wide at the narrowest portion and as narrow as possible to provide said handle with the most effective locking means while still wide enough to allow bag loops access into said bore, said slit extending from an inner surface (48) of the tubular structure to an outer surface (50) of the tubular structure from end to end, said tubular structure not having any ridges or recesses on its outer surface that align in a straight line; and an outer casing (60) of a compressible and resilient material, an outer surface (76) thereof being substantially curved in cross-section, said casing having open ends (68,69) and a longitudinal gap (72) along a top (62) of said casing that extends from its inner surface (74) to its outer surface (76), from end to end; said gap being at least as wide or wider than said slit, and said gap being aligned with said slit to allow bag handles access down into said bore of said tubular structure, said material of said outer casing decreasing in thickness towards each side adjacent said gap such that the outer surface (76) of said casing does not form ninety-degree angles with the sides (73) of said gap, and such that said material of said casing maintains at least a minimum thickness across the approximate middle portion between the ends at a bottom (64) of the casing, wherein the thickness of material at said middle portion of said bottom is at least as thick or thicker than the material at sides (66) of said casing and at sides of the gap at the top of the casing; and wherein said longitudinal gap in said casing is wider at its narrowest portion than said longitudinal slit in said tubular structure at its narrowest portion, so that the edges of said casing at said gap are offset from the edges of said tubular structure at said slit.

26. The ergonomic handle of claim 25, wherein the material of said tubular structure is rounded and/or beveled at, and/or tapers toward any predetermined edges; such that said material varies in thickness at some portion, and does not have only 90 Degree corners; and such that any straight bevels at ends (38 & 39) of said tubular structure are used to form only obtuse, not acute, angles in said material; whereby these exposed edges will be blunted, and therefore less likely to cause any harm to one's hand or said bag loops.

27. The ergonomic handle of claim 25, wherein said material of said casing is rounded and/or beveled at, and/or tapers toward any predetermined edges; such that said material varies in thickness at some portion, and does not have only 90 degree corners.

28. The ergonomic handle of claim 25, wherein said material of said casing and/or the material of said tubular structure tapers or otherwise decreases in thickness, from the side opposite their respective gap or slit towards each side of their said respective gap or slit, across the majority of the length of said handle, so that one or more of the materials of said handle will be thicker at the bottom of said handle than at the top of said handle.

29. The ergonomic handle of claim 25, wherein said material of said casing and/or the material of said tubular structure tapers or otherwise decreases in thickness, from a predetermined portion between said ends towards each said end, such that outer surface (76) of said casing and/or outer surface (50) of said tubular structure gives some portion of said handle a longitudinally convex surface.

30. The ergonomic handle of claim 25, wherein said tubular structure has an aperture, comprising a hole (42) or notch at or near one edge; and said casing has an aperture, comprising a hole or notch (70) at or near one edge, that is aligned with said aperture in said tubular structure; whereby these aligned apertures will allow various objects to be attached to said handle.

31. The ergonomic handle of claim 25, wherein said tubular structure has a tab (44) that extends out from an edge, said tab having a hole (42) extending through it, whereby said hole in said tab will allow various objects to be attached to said handle.

32. The ergonomic handle of claim 25, wherein slit (46) in said tubular structure varies in width, and, at the narrowest portion of said slit, sides (47) of said slit are in direct contact with one another.

33. The ergonomic handle of claim 25, wherein both said tubular structure and said casing have at least one rounded and/or beveled corner at one or both ends of their respective slit or gap, such that each rounded and/or beveled corner in said tubular structure has a corresponding rounded and/or beveled corner in said casing; these aligned, rounded and/or beveled corners forming one or more notches, so that said slit and said gap are wider at one or both ends than they are at some portion between said ends, which will help to guide bag handles into said bore of said tubular structure.

34. The ergonomic handle of claim 25, further including a small hole near one edge, said hole extending from the outer surface of said handle to the inner surface of said handle, and a quick-release secondary connector comprising a clip or similar elements.

35. The ergonomic handle of claim 25, further including a small hole near one edge, said hole extending from the outer surface of said handle to the inner surface of said handle, and a ring-shaped secondary connector comprising a split ring, jump ring, or similar elements.

36. The ergonomic handle of claim 25, further including a multipurpose connector comprising an elastic band, a necklace, a ribbon, a string, or similar elements.

37. The ergonomic handle of claim 25, wherein said casing of said handle has a distinct, intentional pattern on said outer surface.

38. The ergonomic handle of claim 25, wherein said casing of said handle is made of more than one material or more than one density of the same material.

39. The ergonomic handle of claim 25, wherein said outer surface of said casing is rounded at each side of said gap, but said inner surface of said casing is not rounded to each side of said gap.

40. The ergonomic handle of claim 25, wherein said material of said casing tapers lengthwise from the outer surface to the inner surface and from the center towards each end, along the majority of the middle portion of the handle, then sharply rounds at the ends; so that any lengthwise cross-section will show the outer surface of the casing being composed of more than one longitudinal arc from end to end, these longitudinal arcs varying in shape around the circumference of the tubular structure, the central lengthwise arc having the most curvature at said bottom of said casing, and almost none at said top of said casing.

* * * * *